US007891739B2

(12) United States Patent
Cramer

(10) Patent No.: US 7,891,739 B2
(45) Date of Patent: Feb. 22, 2011

(54) APPARATUS FOR MOUNTING A WHEELCHAIR BACK

(75) Inventor: David Cramer, Hartford, WI (US)

(73) Assignee: The Comfort Companies, Inc., Bozeman, MT (US)

( * ) Notice: Subject to any disclaimer, the term of this patent is extended or adjusted under 35 U.S.C. 154(b) by 554 days.

(21) Appl. No.: 11/857,293

(22) Filed: Sep. 18, 2007

(65) Prior Publication Data

US 2009/0072105 A1 Mar. 19, 2009

(51) Int. Cl.
*A47C 7/40* (2006.01)

(52) U.S. Cl. ..... 297/440.2; 297/440.21

(58) Field of Classification Search ..... 248/220.21, 248/220.22, 223.41, 225.11, 222.13, 222.11, 248/221.11; 297/440.2, 354.12, 440.21, 297/353, 354.11, 383, 408, 410
See application file for complete search history.

(56) References Cited

U.S. PATENT DOCUMENTS 5,211,446 A * 5/1993 Jay et al. ..... 297/440.2
5,556,168 A * 9/1996 Dinsmoor et al. ..... 297/440.2
5,593,211 A * 1/1997 Jay et al. ..... 297/383
5,848,824 A * 12/1998 Mocur ..... 297/440.2
5,971,417 A * 10/1999 Swisshelm et al. ..... 280/304.1
6,257,664 B1 * 7/2001 Chew et al. ..... 297/284.9
7,104,610 B2 9/2006 Cramer

* cited by examiner

*Primary Examiner*—A. Joseph Wujciak, III
(74) *Attorney, Agent, or Firm*—Joseph S. Heino; Patrick M. Bergin

(57) ABSTRACT

An apparatus for mounting a wheelchair back that provides a high degree of support and adjustability such that it can be used with wheelchairs that originate from a wide variety of different manufacturers. In order to provide this custom fit, the present invention provide for depth adjustability, height adjustability and angle adjustability of a wheelchair back. The present invention also provides the convenience of a quick-release wheelchair back so that the wheelchair occupant can easily remove the back of the wheelchair from the canes so that the wheelchair can be collapsed and stored. The present mounting system also provides a two point mounting system that is reliable yet simple to use.

10 Claims, 21 Drawing Sheets

SCALE 3.000

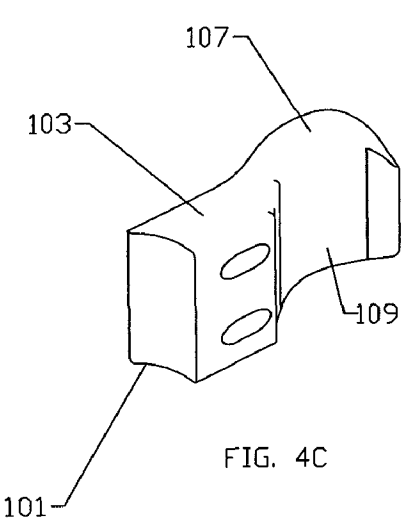
FIG. 4A
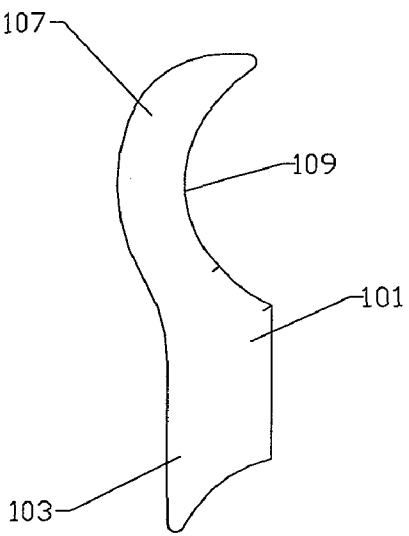
FIG. 4B
FIG. 4C

SCALE 3.000

SCALE 2.000

SCALE 3.000

46
47

42
43

48

45
44

SCALE 3.000
42
43

44
47
43
43
42
SCALE 2.000

SCALE 1.000

SCALE 1.000

SCALE 1.000

SCALE 1.000

SCALE 1.000

SCALE 1.000

SCALE 1.000

SCALE 1.000

SCALE 1.000

SCALE 1.000

FIG. 21A SCALE 2.000

FIG. 21C SCALE 2.000

APPARATUS FOR MOUNTING A WHEELCHAIR BACK

FIELD OF THE INVENTION

The present invention relates generally to wheelchairs and more specifically to adjustable wheelchair backs. In even more detail, the present invention relates to a device and system for mounting a wheelchair back to the upright canes of a wheelchair that provides infinite adjustability in three dimensions. The mounting apparatus and system of the present invention is also adjustable so as to precisely fit a wide variety of existing wheelchairs.

BACKGROUND OF THE INVENTION

People requiring wheelchairs include those affected with cerebral palsy, muscular dystrophy, multiple sclerosis, and head injuries, among other debilitating physical conditions. These individuals often suffer from kyphosis, scoliosis, lordosis and other back ailments. One of the most common complaints of wheelchair occupants is that of pain that is directly related to their use of a wheelchair. Unfortunately, at least some of the problems faced by wheelchair users are further exacerbated by the failure of current designs of wheelchair backs and back systems to properly position a wheelchair occupant.

One problem with current back wheelchair systems is that they are difficult to install and to remove. Disabled users may need to remove and install the wheelchair back to collapse the wheelchair for storage, such as when the user enters and exits motor vehicle.

Yet another problem with current wheelchair back systems is the variability between commercially available wheelchairs. In particular, the upright posts of the wheelchair, or canes, often differ in configuration between wheelchairs. Specifically, in the inventor's experience, the diameter of the canes may vary from between ¾" to 1¼". Additionally, the center-to-center distance of the canes may vary ±2" from the manufacturer's designation. This may also be referred to as the cane-to-cane distance later in this disclosure. An additional problem is that some canes may not be perfectly vertical. To add to the confusion, some manufacturers use metric designations.

An additional problem with current wheelchair back systems is that they are not adaptable to all wheelchair backs. For example, some wheelchairs, particularly those designed for more active lifestyles, have short canes. Therefore, there is little area in which to attach a wheelchair back, which may mean that wheelchair occupants who pursue a more active lifestyle may not be able to take advantage of the benefits offered by a wheelchair having an adjustable back. Additionally, wheelchair occupants, needing their hands for mobility, have little capacity for carrying cargo. Therefore, another problem with current wheelchair back designs is that they leave little room for mounting other accessories, such as bags, to them. Many chairs for highly involved users have gas assist cylinders, saliva suction apparatus, chest harnesses and other accessories that further limit cane space.

Another disadvantage of current wheelchair back systems is that they provide limited adjustability for people of different sizes, shapes and physical needs. For example, a simple sling back wheelchair back provides almost no adjustability. Some wheelchair backs provide limited adjustability, e.g. the wheelchair back can move vertically but has no seat depth adjustability, or the wheelchair back has seat depth adjustability but has no angle adjustability. Often users are put into wheelchairs that are too big or too small. This can cause the patient to be uncomfortable and, in some cases, actually causes skeletal misalignment problems such as scoliosis and/or kyphosis. A properly fitted backrest can improve the interface between the user and the wheelchair.

Another common problem with wheelchair backrests is excessive weight. Wheelchair users propel themselves using their shoulders and arms. This repetitive motion of the wheelchair user's arms can deteriorate the user's arm and shoulder joints over time. Reducing wheelchair weight can help prolong the users' mobility and reduce wear and tear on the user.

Accordingly, what is required is a backrest mounting apparatus and system that can be fitted to the user while the user is seated in the wheelchair. Such a device will reduce the number of transfers during such a fitting. This reduces the chances of falling, torn skin, bruising, etc. This also expedites the fitting process, which allows the therapist to spend more time fine tuning the fit.

Safety and user-friendliness are further important requirements to wheelchair users. Specifically, a quick release mechanism is critical to the user in that it allows the user to collapse the wheelchair for storage and transportation. The ability to transport the wheelchair is important as it allows the user to maintain a level of independence. An additional important feature to those who desire mobility is a collapsible wheelchair. Therefore, what is also required is a lower profile design such that the mounting devices on the canes do not interfere with one another when the wheelchair is collapsed.

An additional requirement is that of easy installation. For example, prior mounting devices required mounting hardware to be clamped onto two tracks, each mounted onto a cane. Commonly, those tracks became misaligned, thereby making the backrest very difficult, if not impossible, to remove and reinstall.

What is also needed is a safer mounting device. Prior devices achieved depth adjustment and quick release by sliding on a set of horizontal rails, each mounted onto a wheelchair cane. Earlier devices simply clamped onto these horizontal rails. If the clamping force was not applied properly by the user, the backrest could move backwards, possibly falling off the wheelchair while in use. While the prior device provided mechanical stops on the ends of the rails to prevent the backrest from falling off completely, the mechanical stops were frequently not installed correctly by users and healthcare workers.

Therefore, what is needed is a wheelchair back mounting apparatus and system that is adaptable to wheelchairs having canes, or upright vertical posts, having a wide variety of different widths. There is also a need for a wheelchair back mounting apparatus and system that takes up less space on the wheelchair canes so as to fit onto wheelchairs with limited space and permit the attachment of other items, such as bags. There is also a need to provide a wheelchair back mounting device and system that provides a wide variety of adjustability so that it can fit all shapes and sizes of people. The backrest weight must be minimized to prolong the mobility of the user. Lastly, there is a need to provide a wheelchair back that is quickly and easily removable such that the wheelchair back can be removed, and the wheelchair collapsed and stored.

SUMMARY OF THE INVENTION

The claimed invention provides an apparatus and system for mounting a wheelchair back that provides a high degree of support and adjustability such that it can be used with wheelchairs from a wide variety of different manufacturers. This adjustability is also beneficial to the occupant of the wheelchair, as the adjustability can provide a wide variety of people with a more custom fit. In order to provide this custom fit, the claimed invention provides for depth adjustability, height adjustability and angle adjustability of a wheelchair back.

The claimed invention also provides the convenience of a quick-release wheelchair back so that the wheelchair occupant can easily remove the back of the wheelchair from the canes so that the wheelchair can be collapsed, stored and transported.

The claimed mounting device and system also provides for an effective two point mounting system. Therefore, the mounting device of the present invention provides a high degree of adjustability with respect to the angle that it can be inclined or declined with respect to prior systems. Additionally, use of a two-point mounting system is particularly important with wheelchairs having short canes, such as those used by more active individuals, as it leaves room for other wheelchair accessories.

The depth, height and width adjustability achieved by the claimed invention uses entirely closed—end components, thereby preventing unwanted travel and possible failure. Further, the quick release is achieved in the vertical plane, which is perpendicular to the applied force of the user. In the event the clamping force is not applied properly to the expanding shaft, it will not fail. Rather, it will remain in the aperture and wiggle around.

The foregoing and other features of the device and system of the present invention will be apparent from the description that follows.

BRIEF DESCRIPTION OF THE DRAWINGS

FIG. 4A is a side elevational view of the outer wheelchair cane clamp.

FIG. 4B is a top or bottom plan view of the outer wheelchair cane clamp.

FIG. 4C is a top and side perspective view of the outer wheelchair cane clamp.

FIG. 21A is a top and side perspective view of an alternative embodiment of the triangle clamp of the claimed invention.

FIG. 21C is a top elevational view of an alternative embodiment of the triangle clamp of the claimed invention.

DETAILED DESCRIPTION

Figure 1:
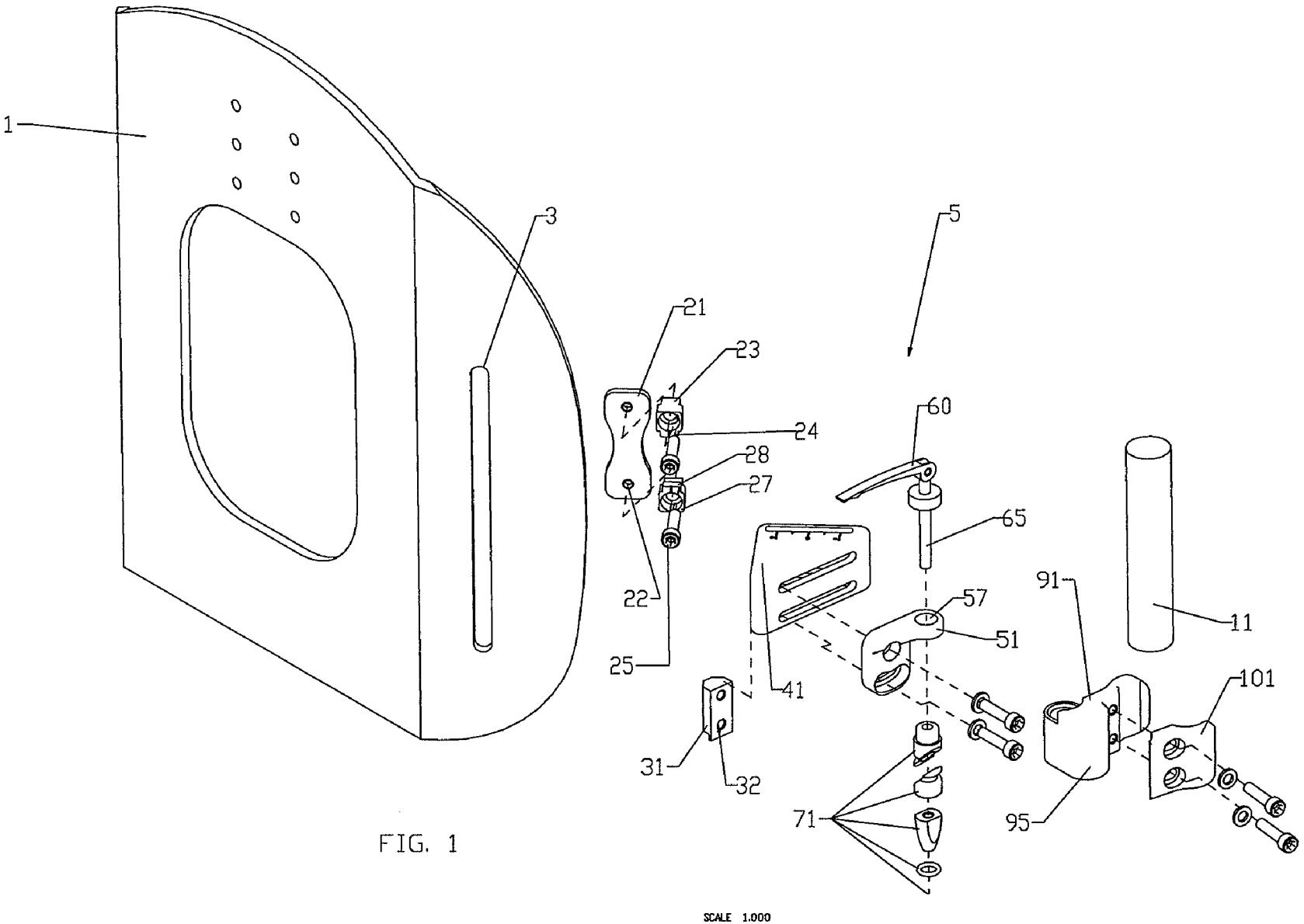
FIG. 1 is an exploded view of a backrest designed for use with a wheelchair together with the mounting device of the claimed invention.
Figure 2C:
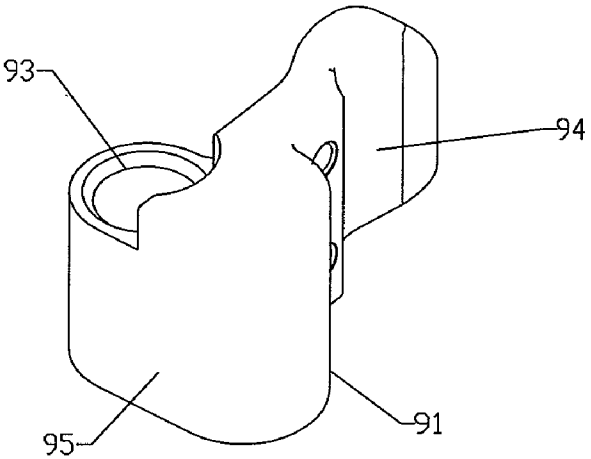
FIG. 2C is a top and side perspective view of the right-side inner wheelchair cane clamp.
Figure 2B:
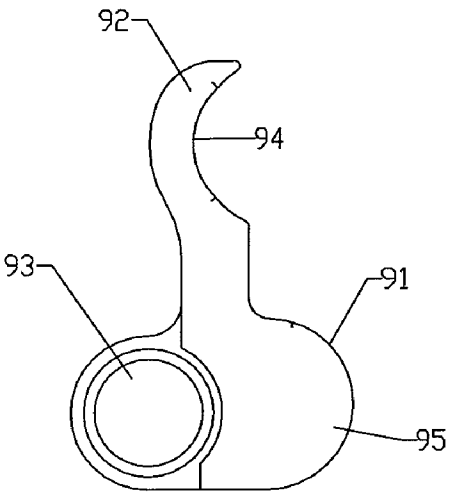
FIG. 2B is a top plan view of the right-side inner wheelchair cane clamp.
Figure 2D:
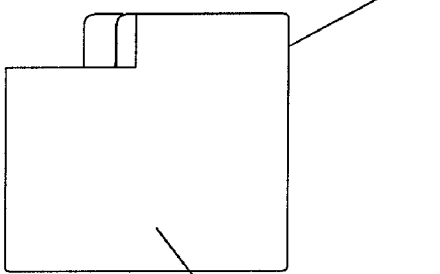
FIG. 2D is an end elevational view of the right-side inner wheelchair cane clamp.
Figure 2A:
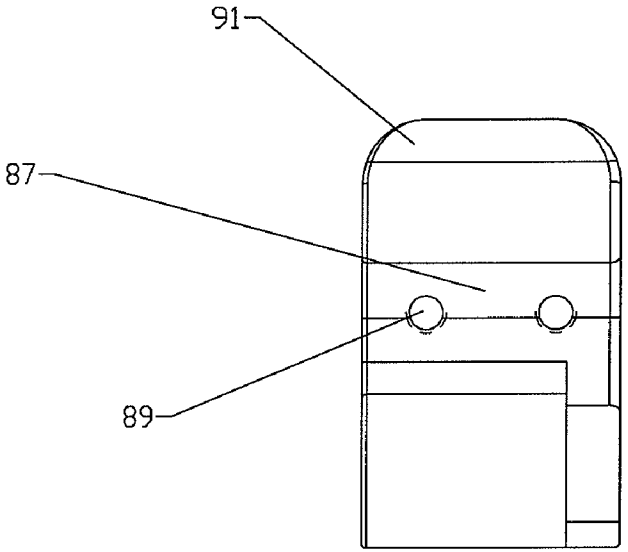
FIG. 2A is a side elevational view of the right-side inner wheelchair cane clamp.
Figure 3C:
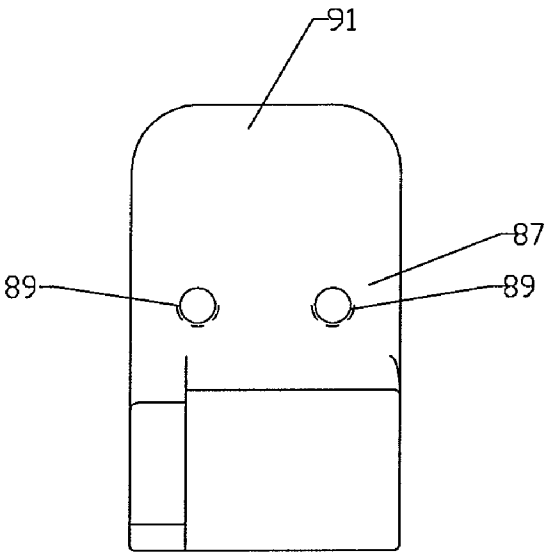
FIG. 3C is a side elevational view of the left side inner wheelchair cane clamp.
Figure 3B:
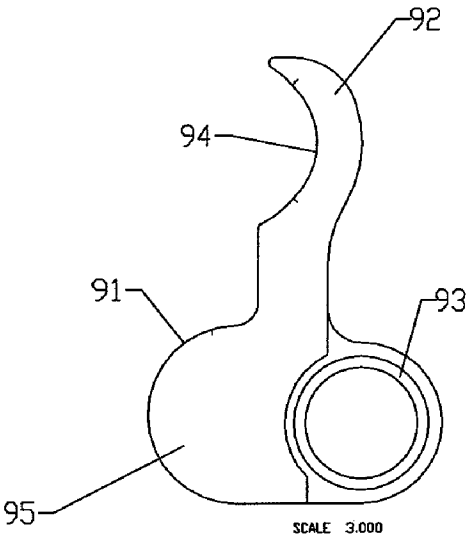
FIG. 3B is a top plan view of the left side inner wheelchair cane clamp.
Figure 3D:
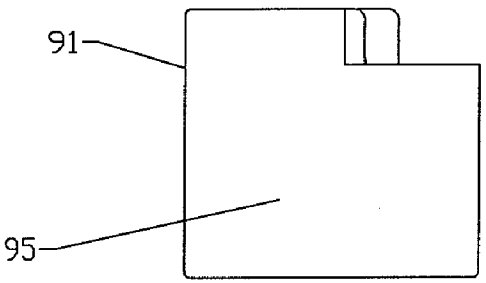
FIG. 3D is an end elevational view of the left side inner wheelchair cane clamp.
Figure 3A:
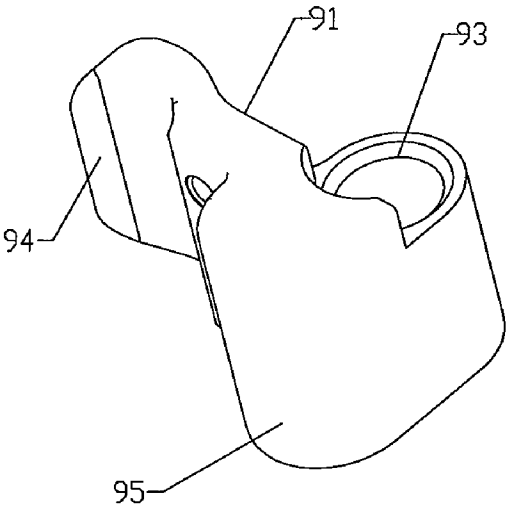
FIG. 3A is a top and side perspective view of the left-side inner wheelchair cane clamp.
Figure 5B:
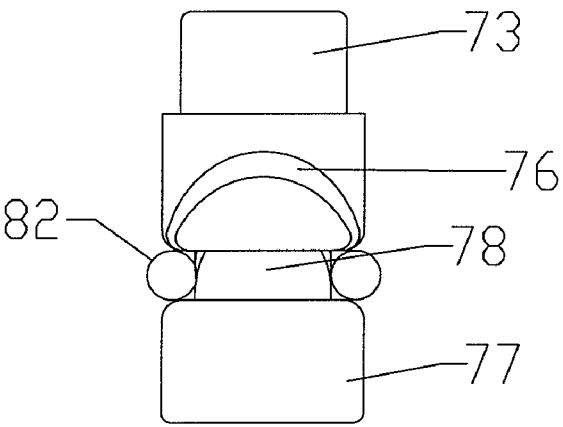
FIG. 5B is a second side elevational view of the expanding post rotated ninety (90) degrees.
Figure 5D:
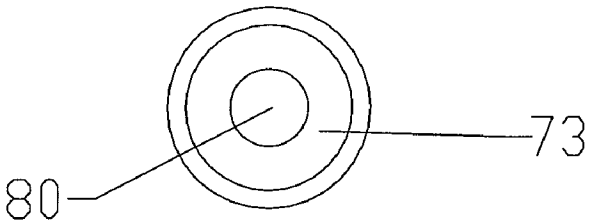
FIG. 5D is a top plan view of the expanding post.
Figure 5A:
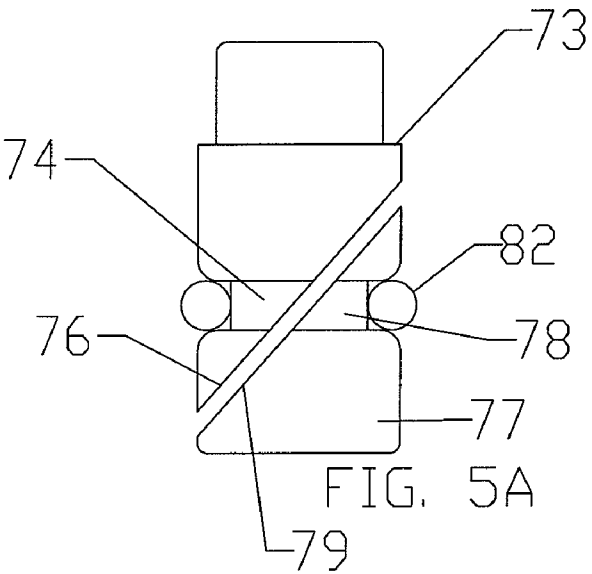
FIG. 5A is a side elevational view of the expanding post.
Figure 5C:
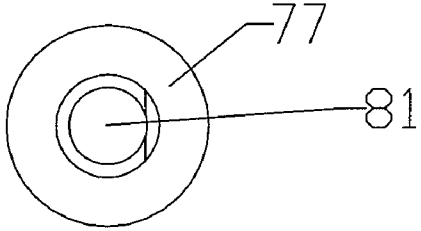
FIG. 5C is a bottom plan view of the expanding post.

Now referring to the drawings in detail, wherein like reference numbers refer to like elements throughout, FIG. 1 shows an exploded view of the claimed invention. Specifically, FIG. 1 shows the backrest 1, the compass mounting hardware of the claimed invention 5 and a portion of the wheelchair cane 11. More specifically, the FIG. 1 shows height adjustment bracket 21, depth adjustment bracket 31, triangle clamp 41, angle adjustment bracket 51, quick release mechanism 60, expanding post mechanism 71, inner cane clamp 91 and outer cane clamp 101, all in an expanded view.

In more specific detail, FIGS. 2A-2D show the right side inner cane clamp 91. FIGS. 3A-3D show the left side inner cane clamp 91, which is a mirror image of the right side inner cane clamp 91. Each inner cane clamp 91 contains a passage 93 therethrough to accommodate the expanding post 71. The inner cane clamps 91 further comprise a curved base 95 opposite the passage 93 and a mid section 87 having apertures 89 therethrough. Opposite the curved base 95 of the inner cane clamp 91 is a hook-shaped extension 92 having an arcuate surface 94.

Now referring to FIGS. 4A-4C, complementary to the inner cane clamp 91 is an outer cane clamp 101 comprising a base 103, the base 103 having at least two apertures 105 and, at the opposite end of the base 103, a hook-shaped extension 107 having an arcuate surface 109. Assembled, via attachment means such as screws through the aperture 89 in the inner cane clamp 91 and the aperture 105 in the outer cane clamp 101, the inner cane clamp 91 and the outer cane clamp 101 remain mounted to the wheelchair canes 11 if the backrest 1 of the wheelchair is removed, e.g., for storage. Preferably, full size socket head screws should be used as it is difficult to strip the heads of socket head screws and they are easy to work with.

The arcuate surface 94 of the inner cane clamp 91 and the arcuate surface 109 of the outer cane clamp 101 have a unique design that allows substantial surface area contact when clamped around both ⅞" and 1" diameter cane tubes, thereby increasing the flexability of the claimed invention to cover various wheelchairs. Alternatively the arcuate surfaces 94 of the inner cane clamp 91 and the arcuate surface 109 of the outer cane clamp 101 could be of virtually any size to accommodate a wide variety of sizes of wheelchair canes 11. A benefit of the lower profile design of the inner cane clamp 91 and the outer cane clamp 101 is that they do not interfere with one another when the wheelchair is collapsed.

Referring now to FIGS. 5A-5C and FIG. 6, they show the quick-release mechanism 60 employed in the claimed invention, although alternative such structures could be used. More specifically, the quick-release mechanism 60 comprises a cam lever 61 and expanding post 71. The expanding post 71 is shown in detail in FIGS. 5A-5C. The expanding post 71 is comprised of an upper tube 73 having a passage 80 therethrough, and angled bottom surface 76 and a groove 74 partially around the angled bottom surface 76. The lower tube 77 contains a passage 81 therethrough, an angled upper surface 79 and a groove 78 partially around the angled upward surface 79. The expanding post 71 is further comprised of a gasket 82, the gasket fitting into the groove 74 in the upper tube 73 and the groove 78 in the lower tube 77 and a post cone 83, the post cone 83 having a threaded passage 84 therethrough.

The quick release cam mechanism 60 comprises a cam toggle 61, a cam roller 63, a cam washer 64 and a threaded skewer 65, the skewer 65 being operable to move upwardly relative to the cam washer 64 when the cam toggle 61 is rotated downwardly.

The upper tube 73 and the lower tube 77 are inserted onto the skewer 65 with the gasket 77 secured thereon. The post cone 83 is then threaded onto the threaded skewer 65 and secured into place using a set screw 85.

It is to be understood that a quick release mechanism 60 is critical to the user in that it allows the user to collapse the wheelchair for storage and transportation. Transportation is important as it allows the user to maintain a level of independence. The claimed invention provides a quick release mechanism 60 that is designed to secure the angle adjustment bracket 51 to the passage 93 in the inner cane clamp 91 and is what releasably secures the wheelchair backrest 1 to the wheelchair.

Figure 6A:
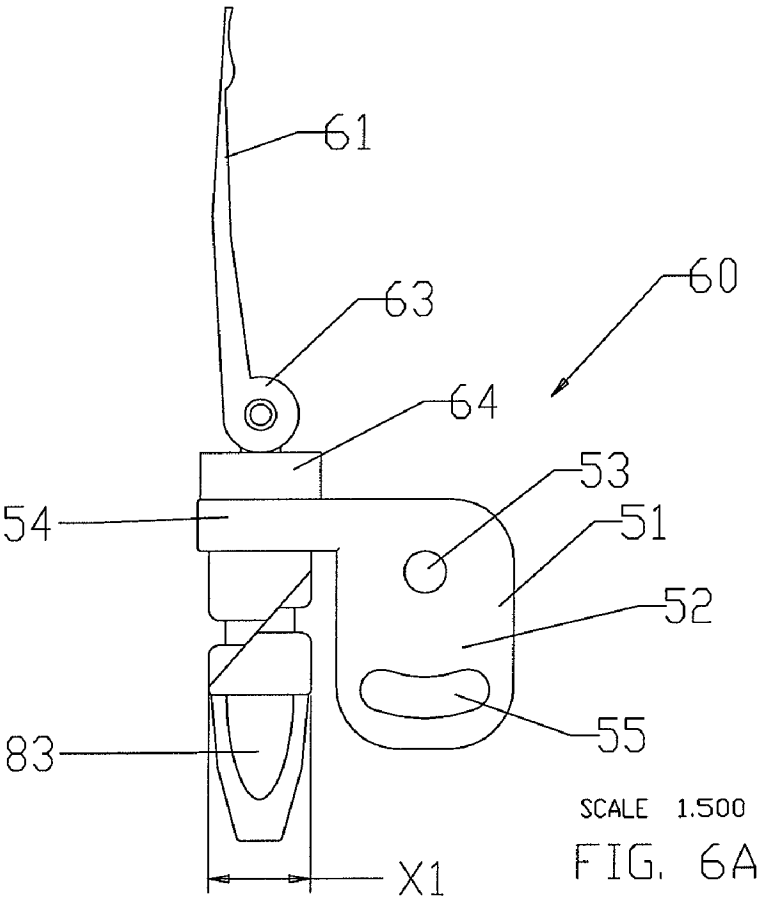
FIG. 6A is a side elevational view of the cam lever and expanding post.
Figure 6B:
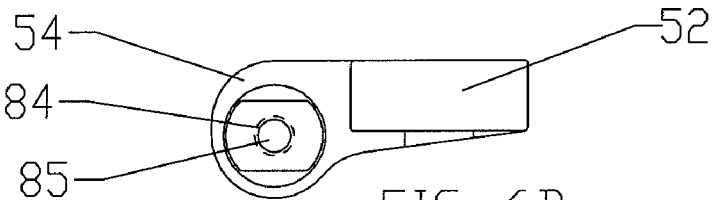
FIG. 6B is a bottom plan view of the expanding post and the angle adjustment bracket.

As shown in detail in FIG. 6, when the cam toggle 61 is relaxed, the overall diameter of the upper tube 73 and the lower tube 77 combined is less than the diameter of the passage 93 in the inner cane clamp 91. To secure the angle adjustment bracket 51 to the inner cane clamp 91, the cam toggle 61 is actuated thereby causing the upper tube 73 and lower tube 77 to slide along the common surface 76, 79 between them, thus causing them to shift outwardly. This shifting movement increases the amount of space consumed by the combination of the upper tube 73 and the lower tube 77 such that the space consumed by upper tube 73 and the lower tube 77 together is greater than the diameter of the passage in the inner cane clamp 91, which effectively locks the angle adjustment bracket 51 to the inner cane clamp 91. When the cam toggle 61 is relaxed, the rubber gasket 81 helps the upper tube 73 and the lower tube 77 maintain a smaller diameter such that the quick release mechanism 60 can be easily inserted into the angle adjustment bracket 51 and inner cane clamp 91 and removed therefrom.

A primary advantage of the claimed invention is that the quick release mechanism 60 moves in the vertical plane, which is perpendicular to the force that is applied to the backrest 1 and toggle 61 by the user. Therefore, in the event the clamping force is not applied properly to the expanding shaft 71, the backrest 1 will not fall off the wheelchair, or even move.

The backrest 1 of the claimed invention is generally comprised of a rigid plastic shell that is normally covered with a foam pad having a fabric cover (not shown). The backrest 1 has a pair of 6¾ inch (six and three quarter inch) vertical slots 3.

The height adjustment bracket 21 comprises a double nut, that is, it comprises a pair of threaded apertures 22, and can be conveniently secured to the backrest 1 using just one tool. The height adjustment bracket 21 is attached to the backrest 1 by a pair of socket head cap screws 25 which additionally secure height clamps 23 to the adjustment bracket 21. Again, see FIG. 1.

Continuing outwardly, FIGS. 8A through 8E and FIGS. 9A through 9D show the left and right triangle clamps 41, which are essentially mirror images of one another, and therefore will be discussed together. The triangle clamp 41 comprises a first side 42 having a pair of parallel longitudinally-extending slots 43, a top side 44 having an longitudinally-extending slot 45, a bottom side 46 having a longitudinally-extending slot 47 that is parallel to the longitudinally-extending slot 45 in the top side 44, and at least one additional side 48.

The triangle clamp 41 is secured to the wheelchair back 1 by the height clamps 23 at the top and bottom of the triangle clamp 41. Specifically, the top height clamp 23 has a downwardly-extending protrusion, or catch 24 that slots within the longitudinally-extending slot 45 in the top 44 of the triangle clamp. Similarly, the bottom height clamp 27 has and upwardly-extending catch 28 that fits within the longitudinally-extending slot 47 on the bottom side 46 of the triangle clamp 41. When the socket head screws 25 are tightened, the upper height clamp and the bottom height clamp 27 secure the triangle clamp 41 in position.

The height clamps 23, 27 also provide up to two (2") inches of variability such that different types of wheelchairs with different cane-to-cane spacing can be accommodated. Specifically, to accommodate wheelchairs having larger cane-to-cane spacing, the height clamps 23, 27 can be moved along the longitudinally extending slot 47 in the top 44 of the triangle clamps 41 and the edge 47 of the bottom 46 of the triangle clamp. Measuring indica are provided on the top 44 of the triangle clamps 41 such that the backrest 1 can be visually centered between the wheelchair canes 11 without other tools.

Figure 12B:
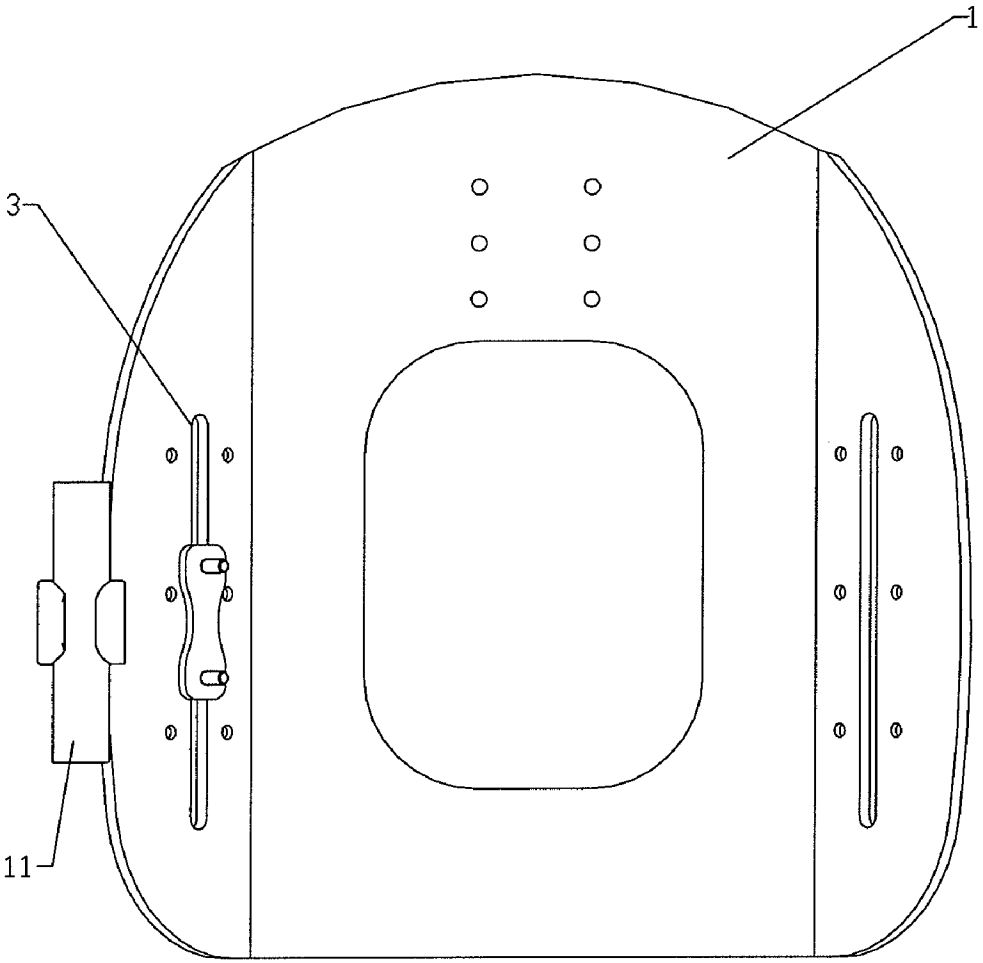
FIG. 12B is front elevational view of the backrest and mounting device of the claimed invention showing the seatback adjusted 2" (two inches) back.
Figure 12A:
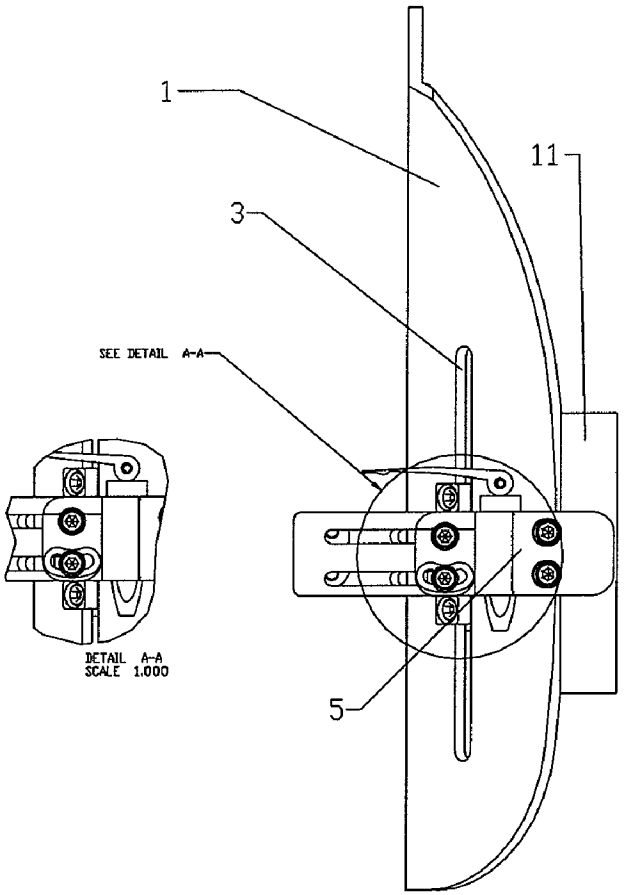
FIG. 12A is a side elevational view of the depth adjustment mechanism of the claimed invention showing the seatback adjusted 2" (two inches) back.
Figure 14A:
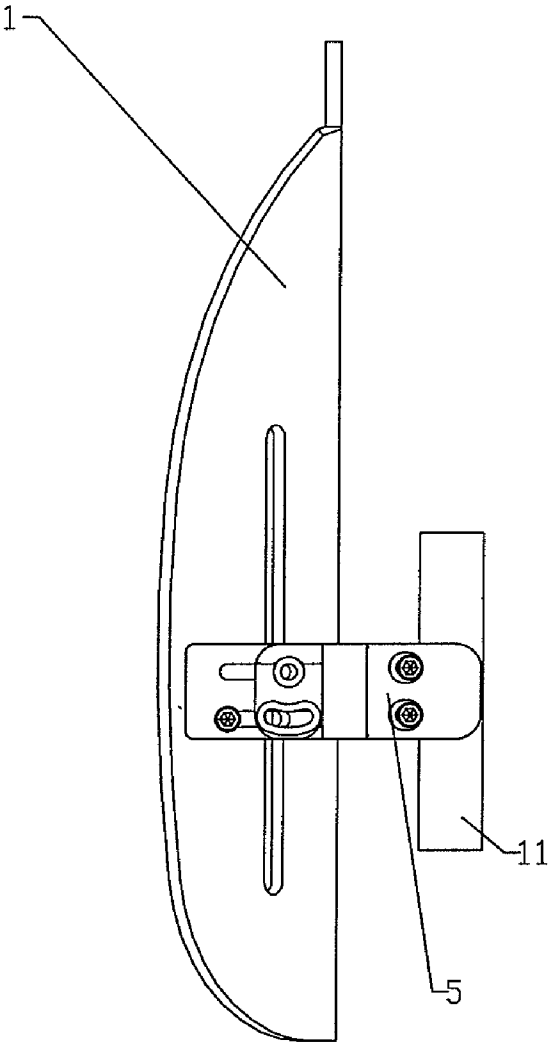
FIG. 14A is a side elevational view of the backrest and mounting device of the claimed invention wherein the mounting device is reversed to provide a shallow wheelchair back.
Figure 14B:
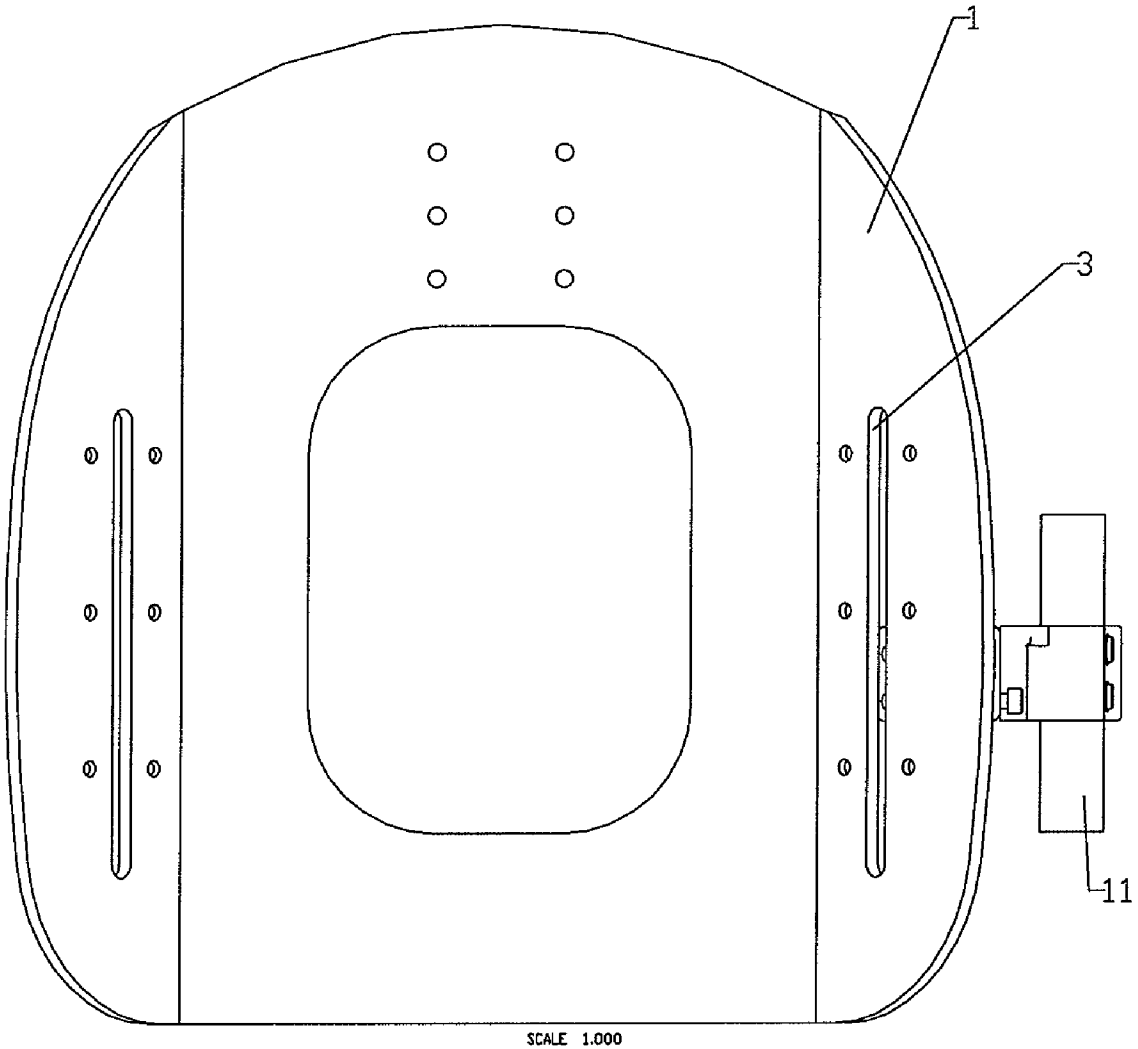
FIG. 14B is a front elevational view of the backrest and mounting device of the claimed invention wherein the mounting device is reversed to provide a shallow wheelchair back.

The triangle clamp 41 is attached to the angle adjustment bracket 51 via depth adjustment bracket 31. The depth adjustment bracket 31 contains a pair of tapped apertures 32 such that it effectively serves as a double nut whereby the angle adjustment bracket 51 can be secured to the triangle clamp 41 with just one tool. As shown in FIGS. 12A and 12B, using the combination of the slots 43 in the triangle bracket and the depth adjustment bracket 31 the backrest 1 is permitted 2" (two inches) of depth adjustment. An additional 2" (two inches) of depth adjustment is available if the inner cane clamp 91 and the outer cane clamp 101 are mounted on the front of the wheelchair canes 11 as shown in FIGS. 14A and 14B. An important advantage of the claimed invention is that the claimed invention has depth adjustment capabilities that are achieved using slots that are closed on their ends, thereby preventing unwanted travel and thus failure.

An alternative embodiment of the triangle clamp 121 is shown in FIGS. 21A through 21E. The main distinction between this embodiment and that described above is the addition of flanges 122 on the top 44 and bottom 46 of the triangle clamp 121. These flanges 122 contain longitudinally extending slots 123. The slots 123 are designed to replace the height clamps and provide a simpler mechanism that is less expensive to produce but permits the same range of motion as the embodiment described above.

Figure 7:
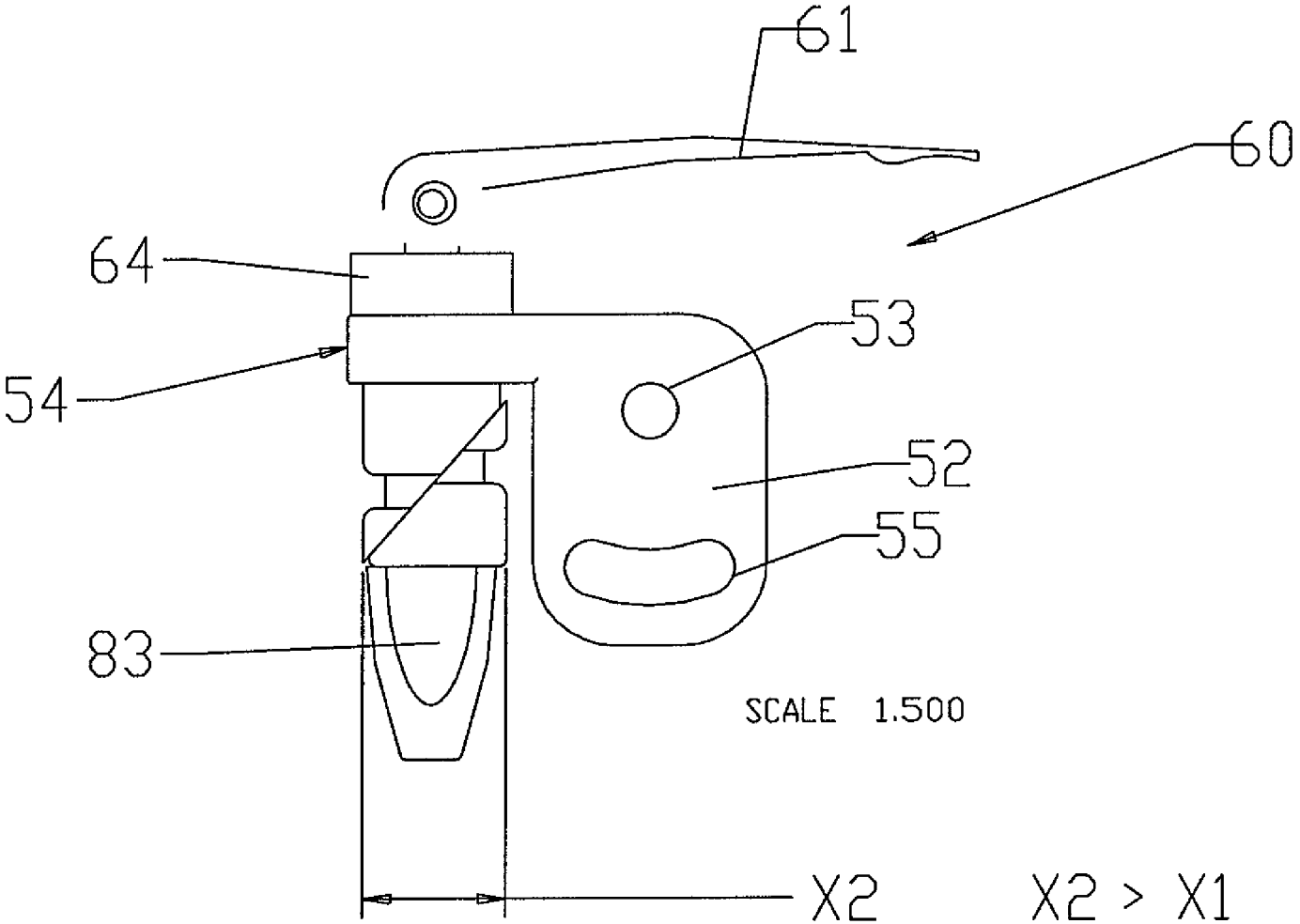
FIG. 7 is an expanded view of the cam lever and expanding post.
Figure 8E:
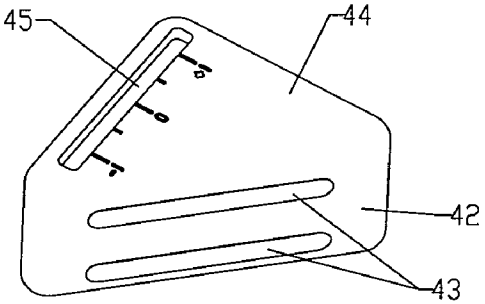
FIG. 8E is a top and side persepective view of the left triangle clamp.
Figure 8F:
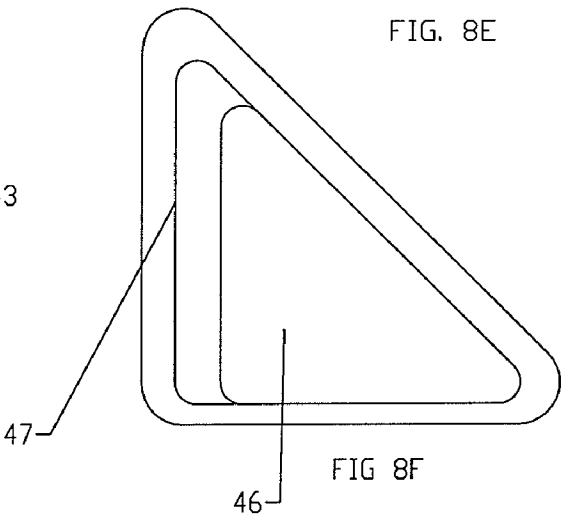
FIG. 8F is a bottom view of the left triangle clamp.
Figure 8D:
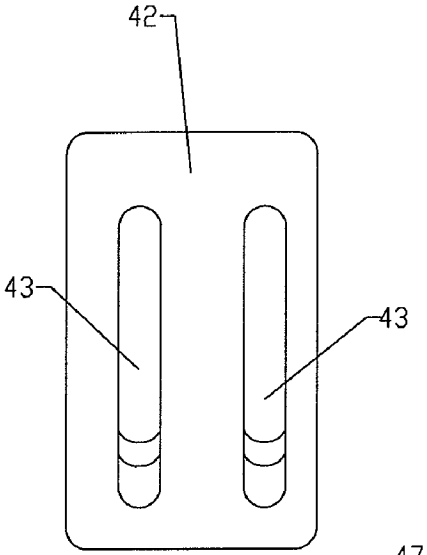
FIG. 8D is an additional side elevational view of the left triangle clamp
Figure 8A:
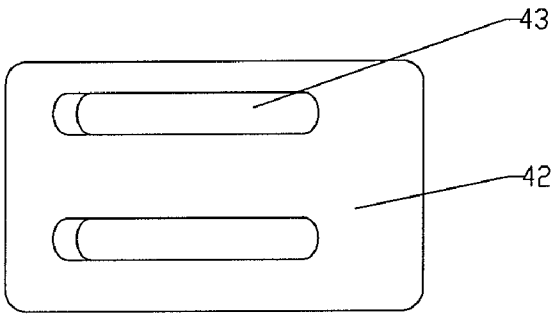
FIG. 8A is a side elevational view of the left triangle clamp.
Figure 8B:
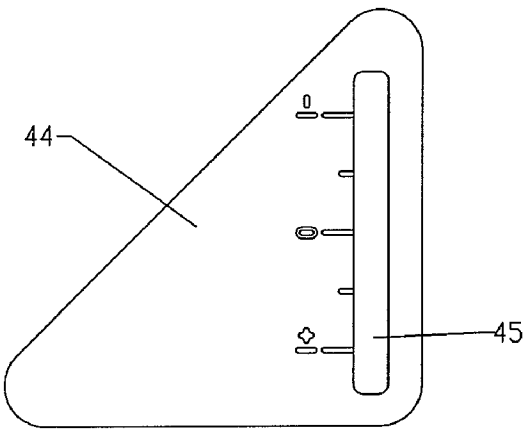
FIG. 8B is a top elevational view of the left triangle clamp.
Figure 8C:
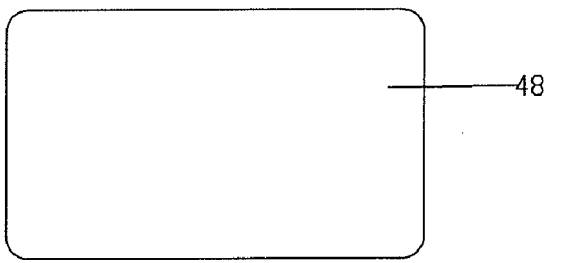
FIG. 8C is a backside elevational view of the left triangle clamp.
Figures 9A, 9B, 9C, 9D, 9E, 9F:
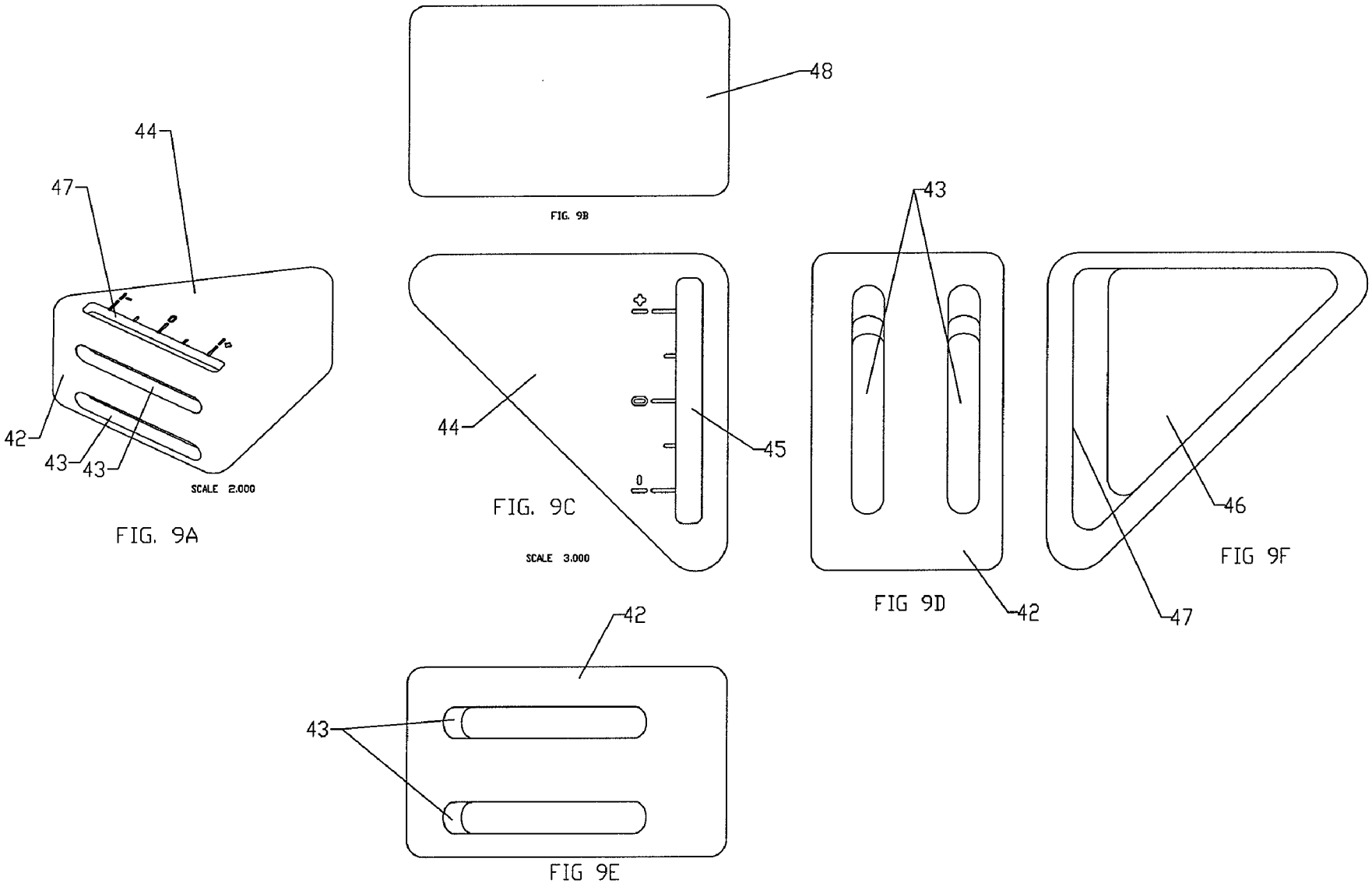
FIG. 9A is a top and side perspective view of the right triangle clamp.
FIG. 9B is backside elevational view of the right triangle clamp.
FIG. 9C is a top side elevational view of the right triangle clamp.
FIG. 9D is a side elevational view of the right triangle clamp.
FIG. 9E is an additional side elevational view of the right triangle clamp.
FIG. 9F is a bottom elevational view of the right triangle clamp.

The angle adjustment bracket 51 is generally comprised of a lower portion 52 and an upper portion 54. See FIGS. 6 and 7. The lower portion 52 comprises a first aperture 53, and a second arc-shaped angle adjustment aperture 55. In an embodiment of the claimed invention the angle adjustment aperture 55 permits adjustment of the backrest 1 ±15° from vertical (+/−15 degrees). As shown in FIG. 1, the upper portion 54 of the angle adjustment bracket 51 contains a passage 57 therethrough, the passage 57 being slightly larger than the diameter of the upper tube 73 and the lower tube 77 such that the quick release mechanism 60 can be inserted therethrough to releasably secure the angle adjustment bracket 51 to the inner cane clamp 91.

Figure 10B:
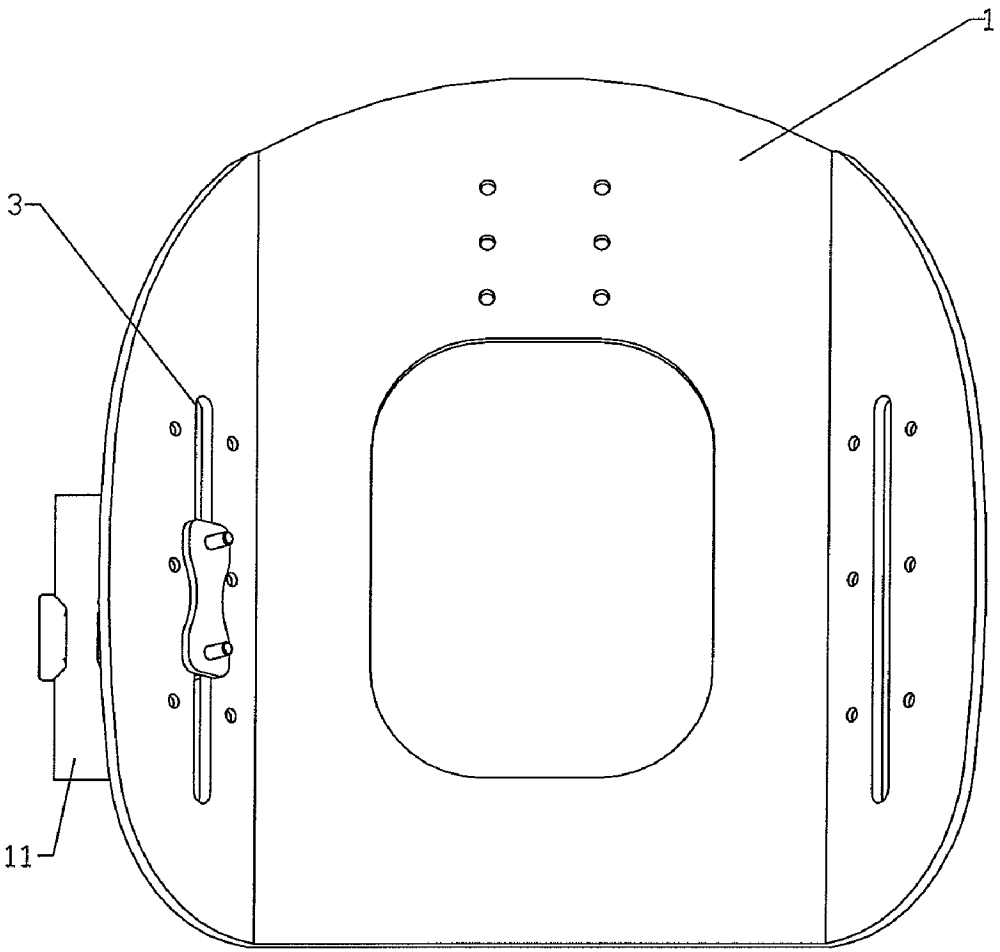
FIG. 10B shows as front view of the backrest and mounting device of the claimed invention reclined at approximately fifteen (15) degrees from vertical.
Figure 10A:
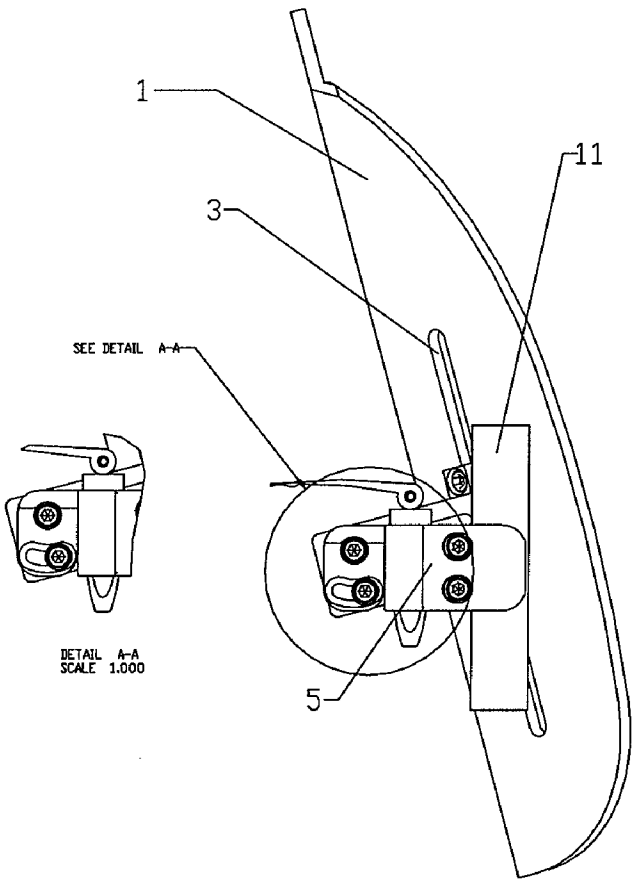
FIG. 10A shows a right side view of the backrest and mounting device of the claimed invention reclined at approximately fifteen (15) degrees from vertical.
Figure 11B:
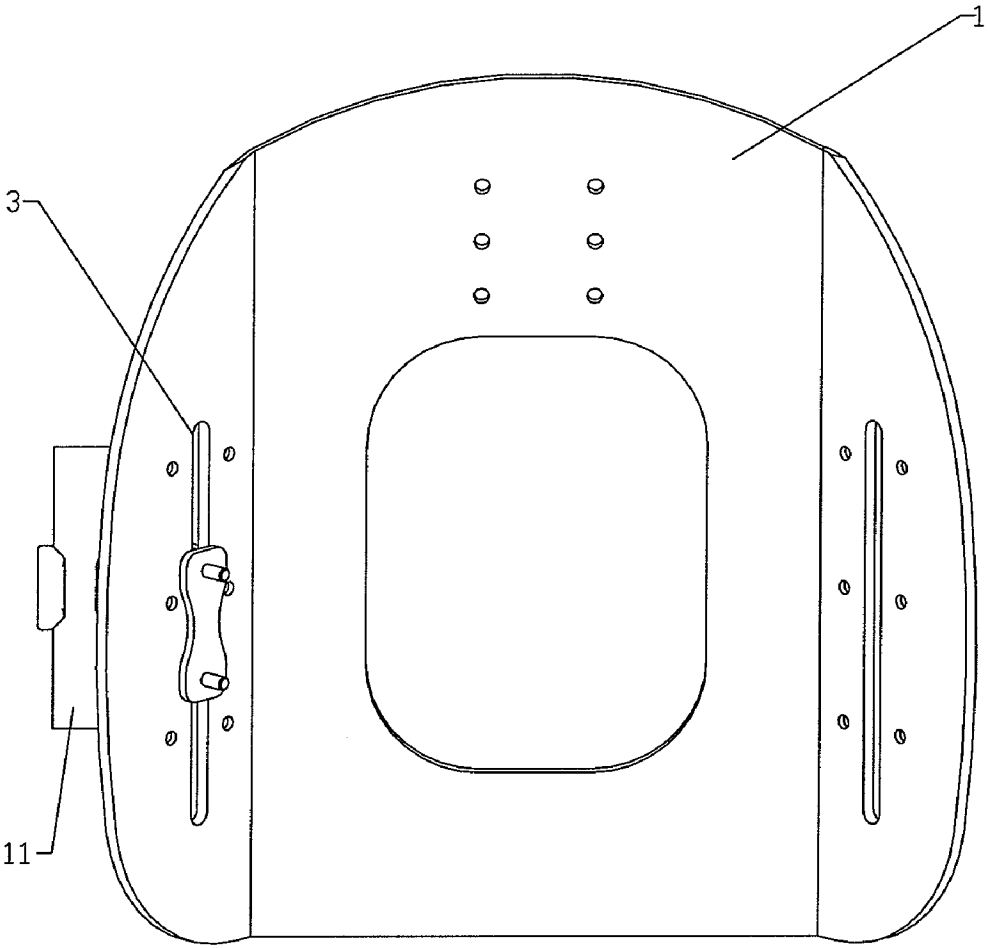
FIG. 11B shows a front view of the backrest and mounting device of the claimed invention inclined at approximately fifteen (15) degrees from vertical.
Figure 11A:
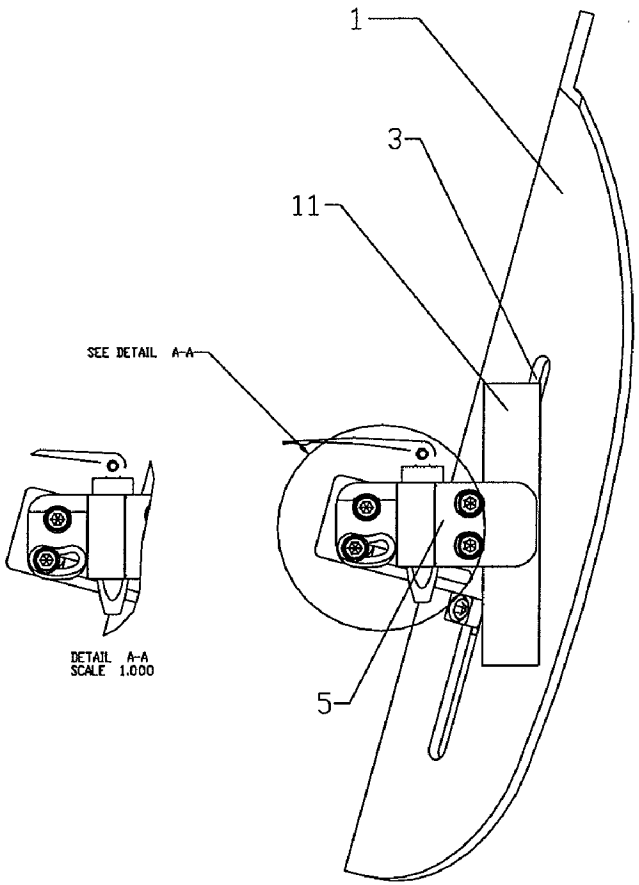
FIG. 11A shows a right side view of the backrest and mounting device of the claimed invention inclined at approximately fifteen (15) degrees from vertical.
Figure 13B:
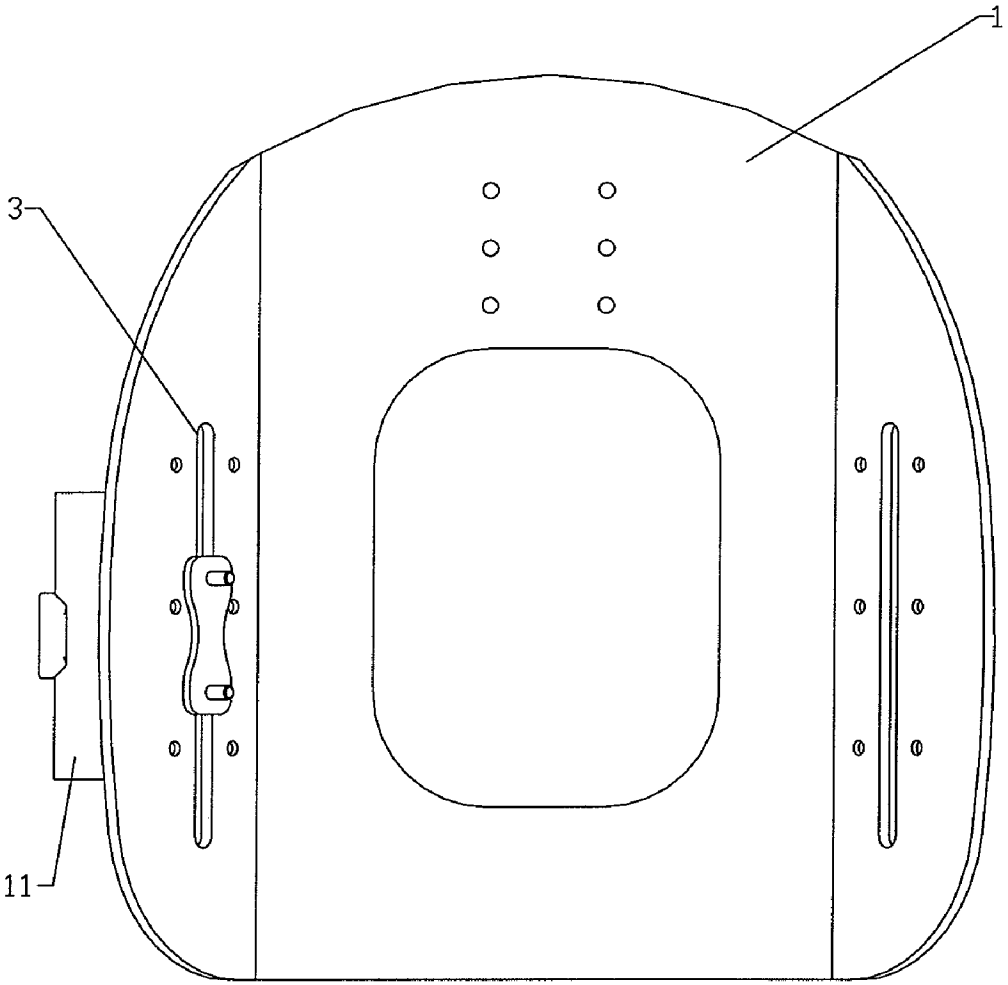
FIG. 13B is front elevational view of the backrest and mounting device of the claimed invention showing the seatback adjusted 0" (zero inches) back.
Figure 13A:
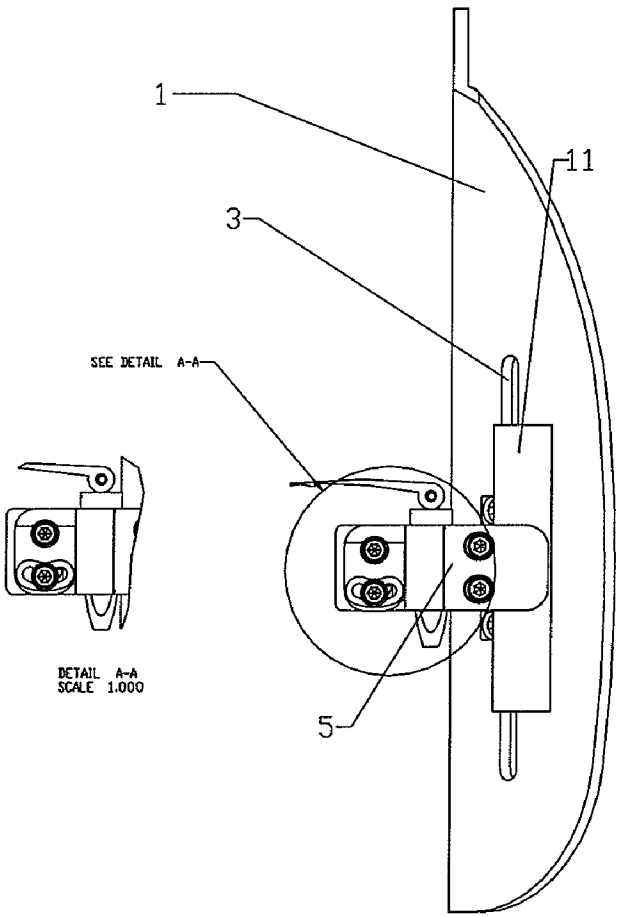
FIG. 13A is a side elevational view of the depth adjustment mechanism of the backrest and mounting device of the claimed invention showing the seatback adjusted 0" (zero inches) back.

Now referring to the exemplary drawings, FIG. 10A shows a side view of the backrest of the claimed invention reclined 15° (fifteen degrees) from vertical. FIG. 10B shows the complementary front view of the reclined backrest 1. FIGS. 11A and 11B show side and front views of the claimed invention with the backrest 1 rotated forward 15° (fifteen degrees) from vertical. FIGS. 12A and 12B show views of the backrest 1 showing the backrest adjusted 2" (two inches) back. FIGS. 13A and 13B show the backrest 1 of the claimed invention in its furthest forward position with the cane clamps 91,101 in the standard position. As discussed above and shown in FIGS. 14A and 14B, the cane clamps 91,101 could be reversed for an additional 2" (two inches) of rearward adjustability.

Figure 15B:
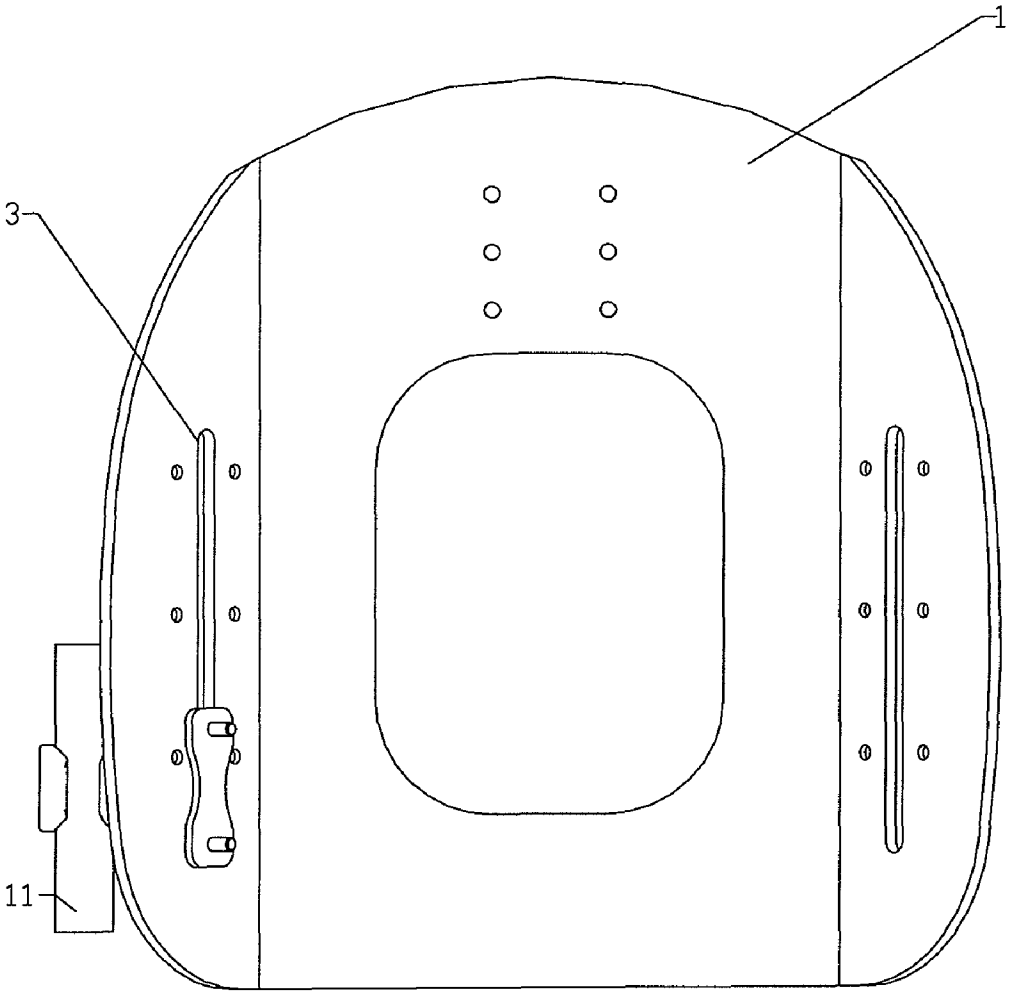
FIG. 15B is a front elevational view of the backrest and mounting device of the claimed invention showing the seatback adjusted 5" (five inches) upwardly.
Figure 15A:
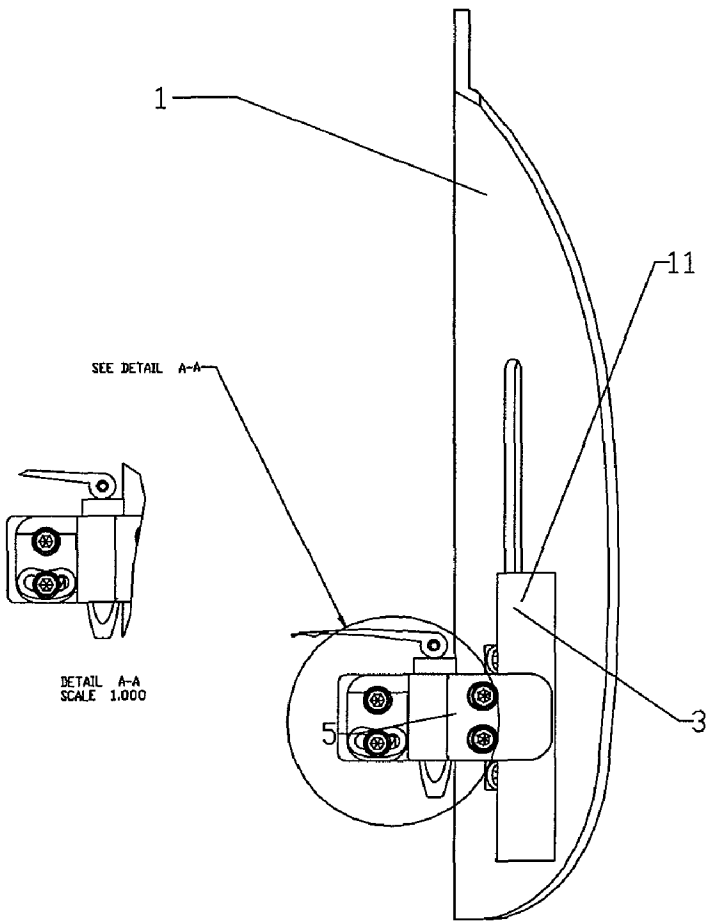
FIG. 15A is a side elevational view of the backrest and mounting device of the claimed invention showing the seatback adjusted 5" (five inches) upwardly.
Figure 16B:
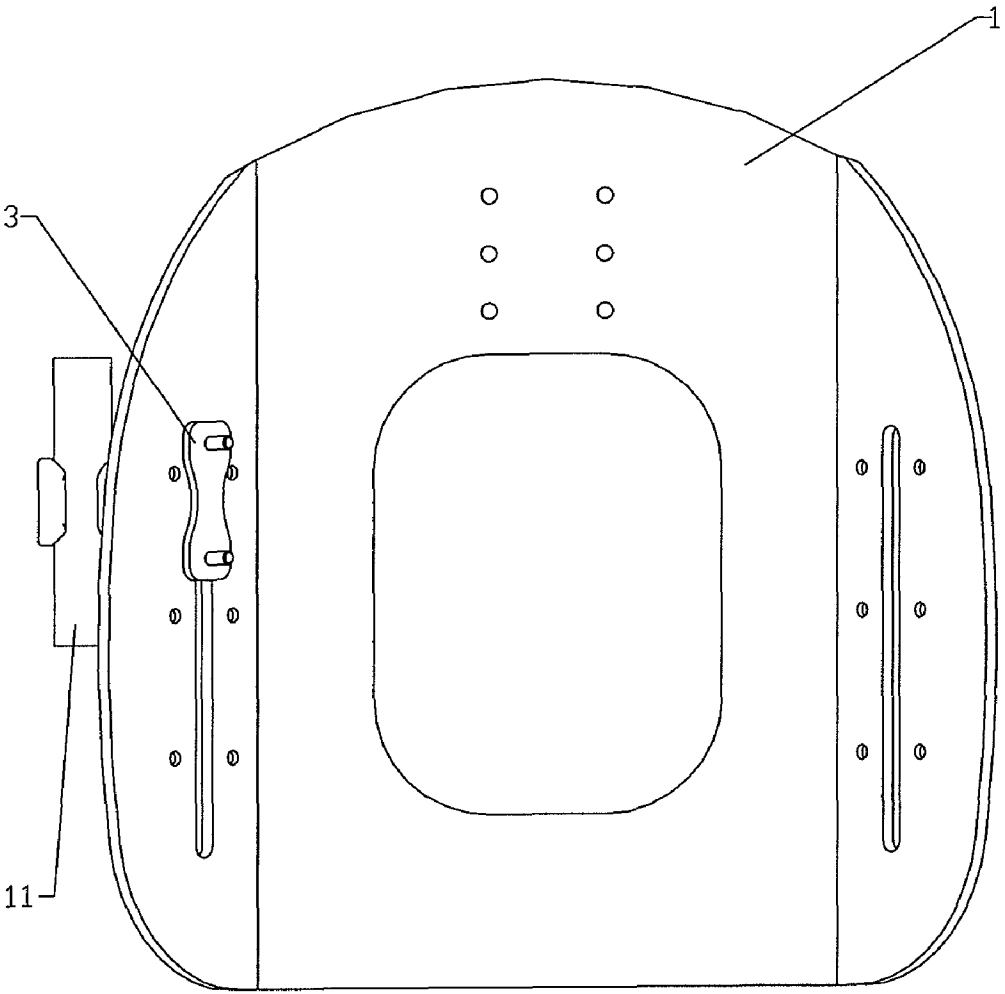
FIG. 16B is a front elevational view of the backrest and mounting device of the claimed invention showing the seatback adjusted 5" (five inches) downwardly.
Figure 16A:
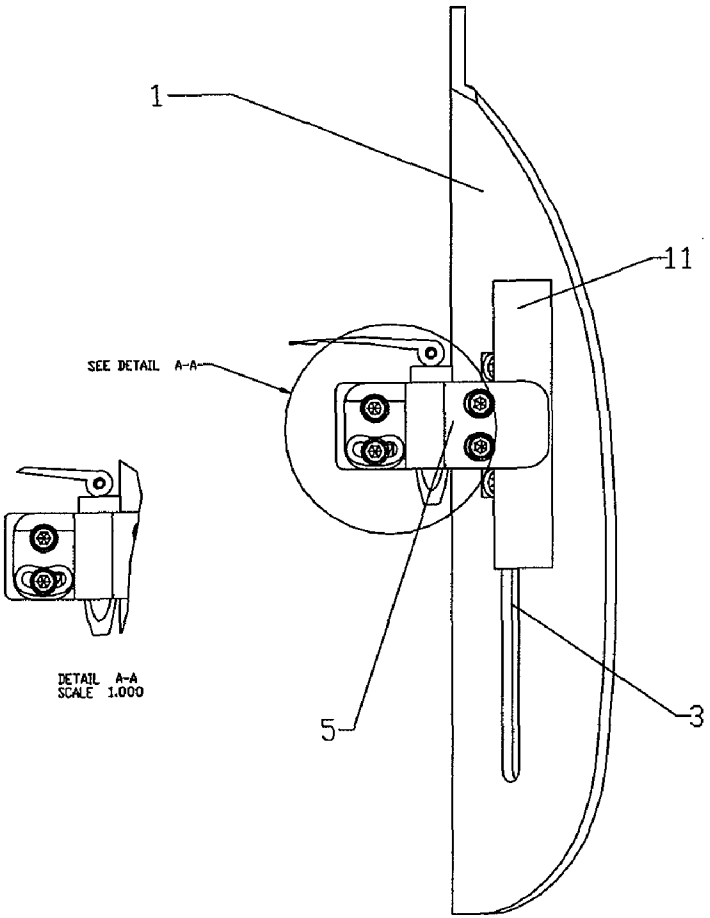
FIG. 16A is a side elevational view of the backrest and mounting device of the claimed invention showing the seatback adjusted 5" (five inches) downwardly.

FIGS. 15A and 15B demonstrate the adjustability of the wheelchair back in the vertical direction, specifically in comparison to FIGS. 16A and 16B. In FIGS. 15A and 15B, the backrest 1 is adjusted upwardly relative to the claimed invention, while in FIGS. 16A and 16B, the backrest 1 is adjusted downwardly relative to the claimed invention.

Figure 17B:
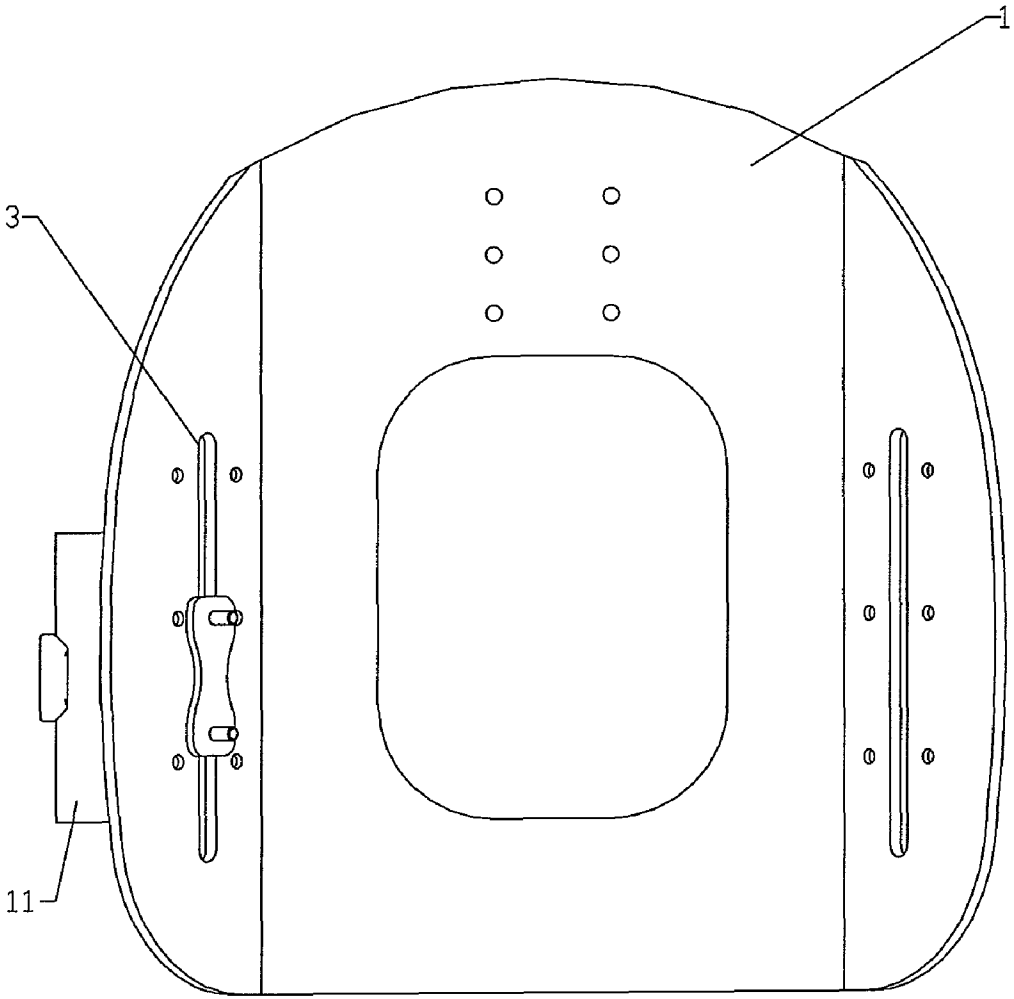
FIG. 17B is a front elevational view of the backrest and mounting device of the claimed invention showing the seat-back in roughly the middle of its vertical adjustment.
Figure 17A:
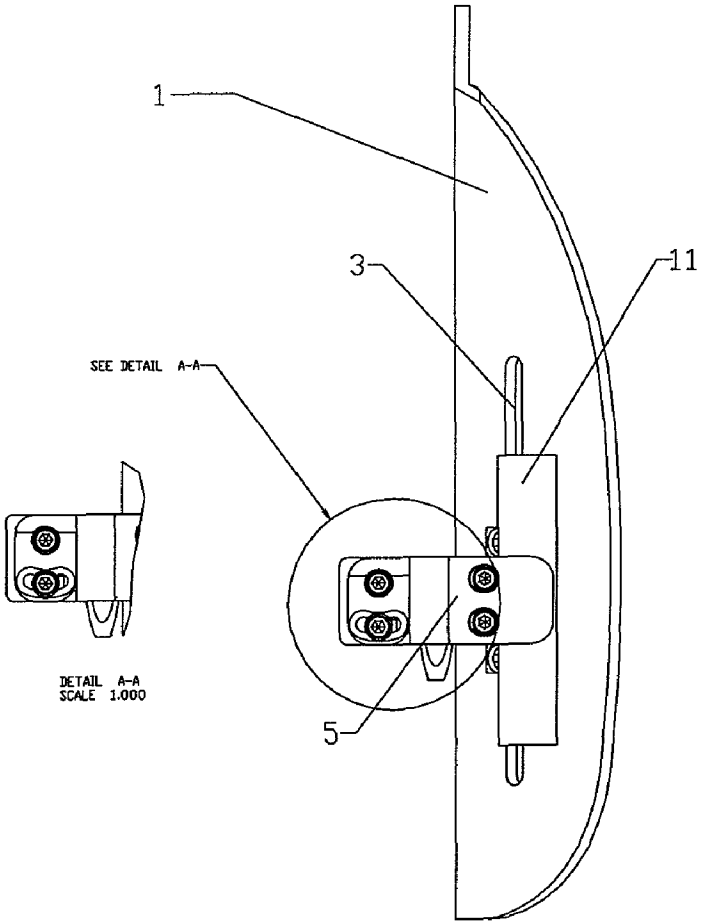
FIG. 17A is a side elevational view of the backrest and mounting device of the claimed invention showing the seat-back in roughly the middle of its vertical adjustment.
Figure 18:
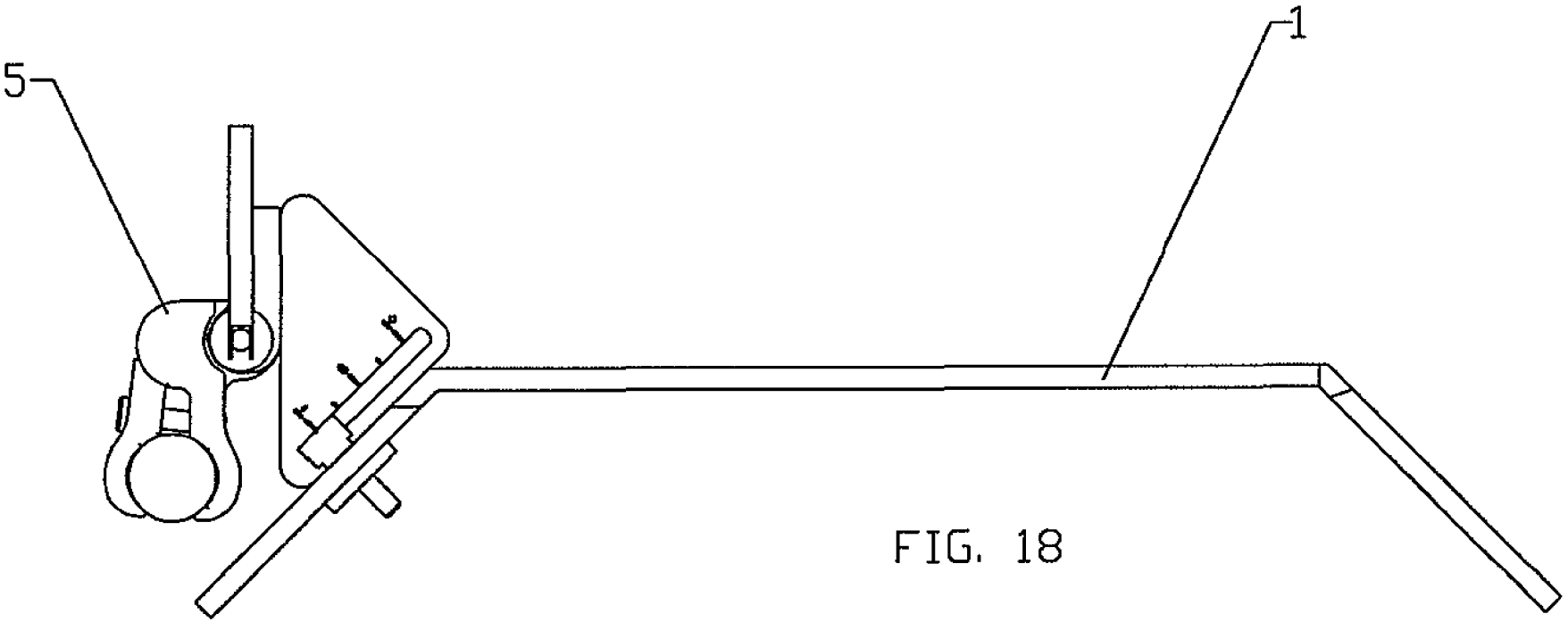
FIG. 18 is a top plan view of the backrest and mounting device of the claimed invention for a wheelchair having a relatively smaller cane to cane distance.
Figure 19:
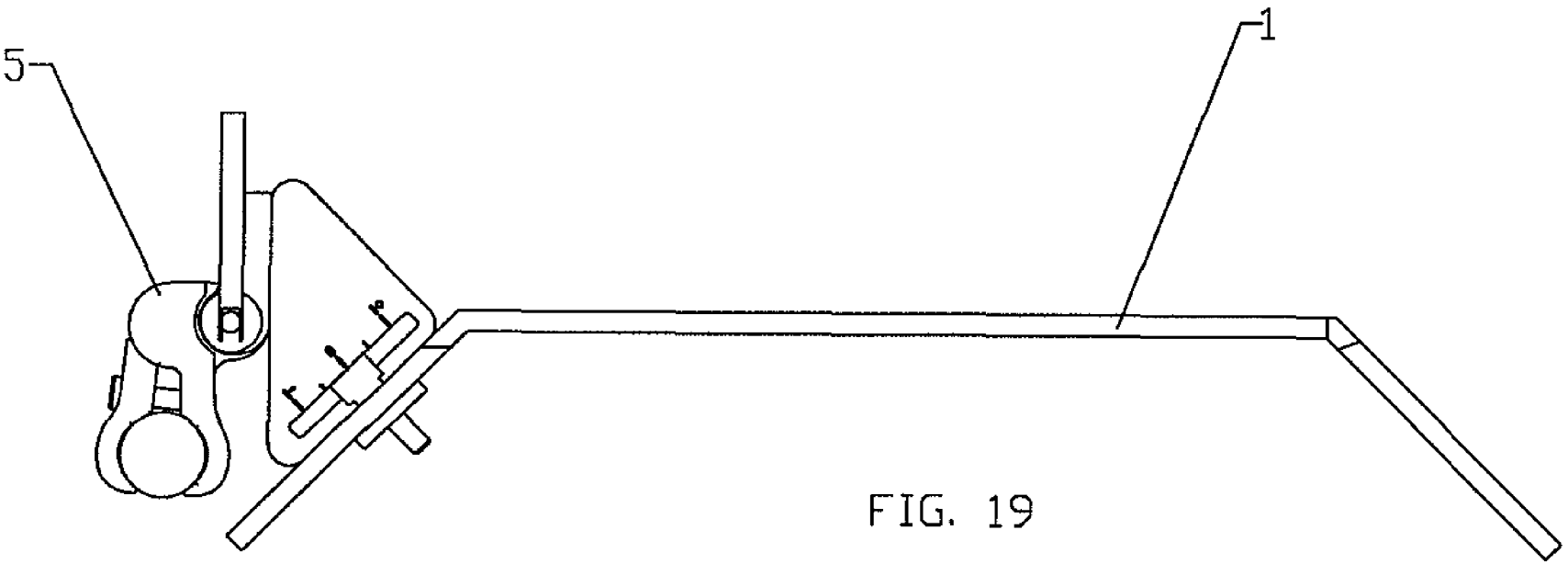
FIG. 19 is a top plan view of the backrest and mounting device of the claimed invention for a wheelchair having a relatively neutral cane to cane distance.
Figure 20:
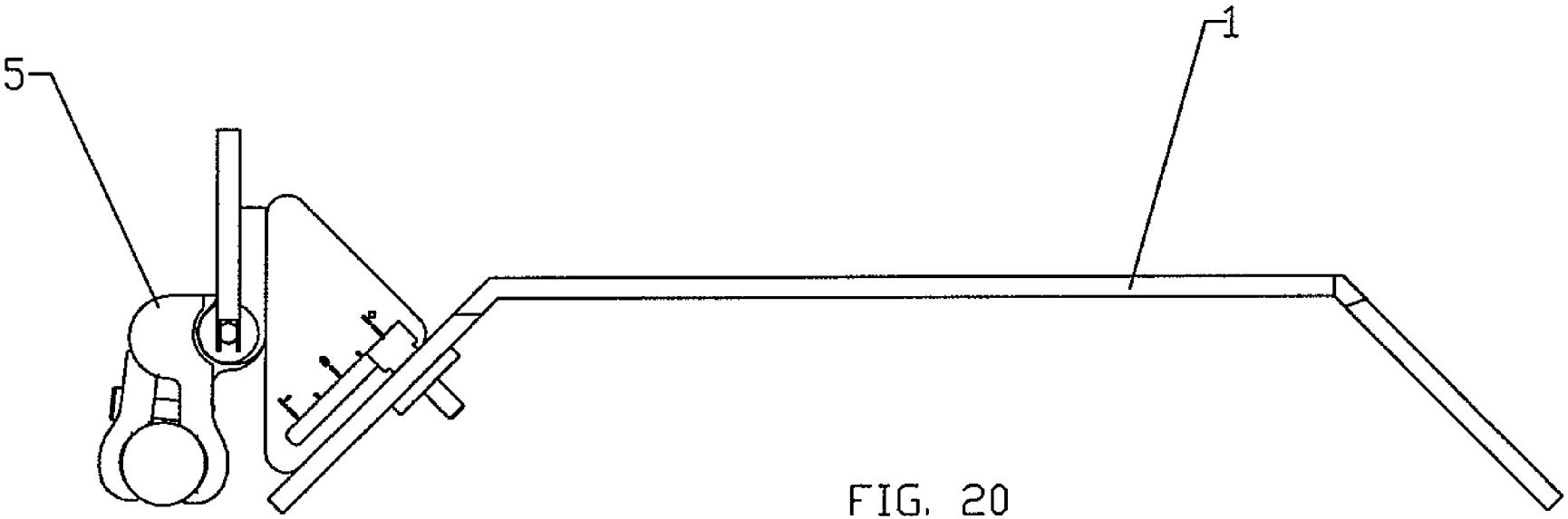
FIG. 20 is a top plan view of the backrest and mounting device of the claimed invention for a wheelchair having a larger cane-to-cane distance.
Figure 21F:
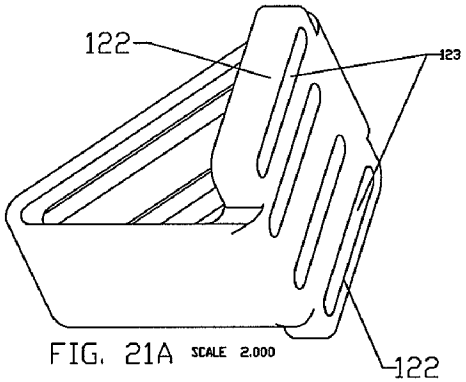
FIG. 21F is a bottom elevational view of an alternative embodiment of the triangle clamp of the claimed invention.
Figure 21F:
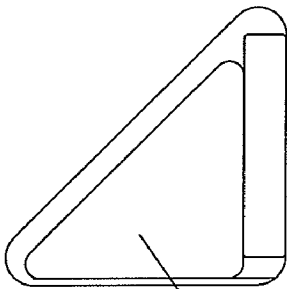
Figure 21D:
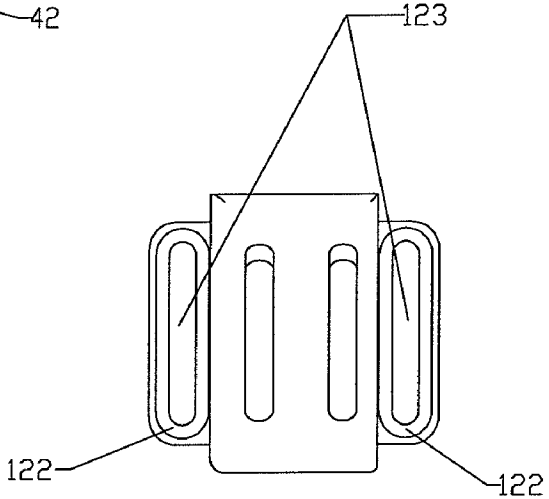
FIG. 21D is an additional side elevational view of an alternative embodiment of the triangle clamp of the claimed invention.
Figure 21B:
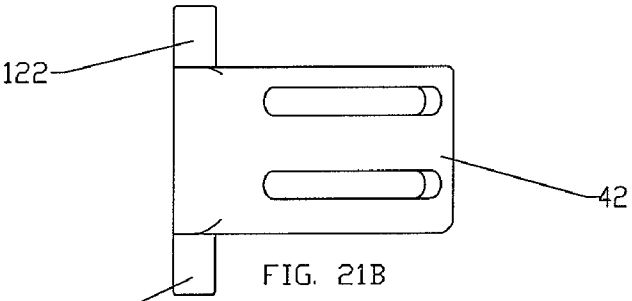
FIG. 21B is a side elevational view of an alternative embodiment of the triangle clamp of the claimed invention.
Figure 21E:
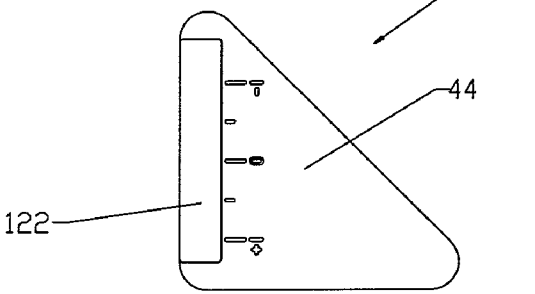
FIG. 21E is a back elevational view of an alternative embodiment of the triangle clamp of the claimed invention.
Figure 21E:
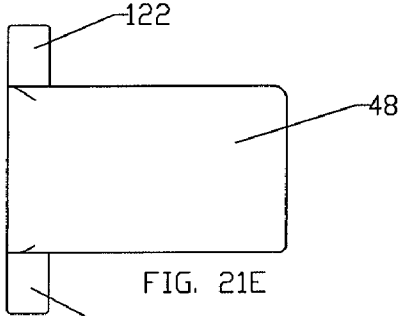

FIGS. 17 and 18 demonstrate the adaptability of the claimed invention to various types of wheelchairs. The distance between the canes 11 of a wheelchair is variable between wheelchair manufacturers. Therefore, it is useful to have an attachment means which is capable of securing to a wide variety of wheelchairs of different manufacture. The claimed invention permits such variation by providing up to 2" (two inches) of width accommodation.

The claimed invention has many advantages over other backrest mounting devices. Specifically, the claimed invention allows for 5" of height adjustment, 4" of depth adjustment and 15 degrees of adjustment fore/aft of vertical for a total of 30 degrees. Further, all of this adjustability is accomplished in a compact assembly that is both functional and stylish.

Importantly, all adjustments can be performed while the user is seated in the wheelchair. This is an important distinction over competitor hardware systems because it reduces the number of transfers during such a fitting. This reduces the chances of falling, torn skin, bruising, etc. This also expedites the fitting process, which allows the therapist to spend more time fine tuning the dimensions.

Of additional importance to the user is that the present invention is substantially lighter than prior backrest mounting systems. Specifically the present mounting system is 0.5 lbs (½ pound) lighter than prior mounting systems, a 25% (twenty-five percent) reduction. Such a weight reduction is critical in prolonging the users' ability to propel themselves as the repetitive motion of propelling the wheelchair can cause injuries to and general deterioration of the users' body, including injuries to the user's rotator cuffs, and user's elbows and wrists.

Although I have very specifically described the preferred embodiments of the invention herein, it is to be understood that changes can be made to the improvements disclosed without departing from the scope of the invention. Therefore, it is to be understood that the scope of the invention is not to be overly limited by the specification and the drawings, but is to be determined by the broadest possible interpretation of the claims.

What is claimed is:

1. An apparatus for mounting a backrest to the cane of a wheelchair, the backrest comprising a generally rigid shell, the shell having a generally vertical slot; the apparatus comprising:

a releasably securable height adjustment bracket, the height adjustment bracket being releasably securable to the generally vertical slot in the shell of the backrest;

a triangle clamp, the triangle clamp having a first side being securable to the height adjustment bracket, the triangle clamp having a second side;

a releasably securable angle adjustment bracket securable to the second side of the triangle clamp;

a cane clamp assembly removably attachable to the cane of the wheelchair, the cane clamp assembly providing a generally upwardly facing aperture, wherein the cane clamp is connected to the angle adjustment bracket through the upwardly facing aperture; and a means for releasably securing the cane clamp through the upwardly facing aperture to detach the angle adjustment bracket for collapsing the wheelchair.

2. The apparatus of claim 1 wherein the height adjustment bracket comprises at least two threaded apertures and is releasably securable to the backrest by screws, the height adjustment bracket being vertically adjustable within the vertical slot in the backrest.

3. The apparatus of claim 2 wherein the height adjustment bracket has 5 inches of adjustability.

4. The apparatus of claim 1 wherein the triangle clamp further comprises a top side having a slot and a bottom side, the triangle clamp being secured to the backrest by the height adjustment bracket, width adjustability being provided by moving the height adjustment bracket horizontally along the slot on the top side and the bottom side of the triangle clamp.

5. The apparatus of claim 4 wherein the triangle clamp provides up to two inches of width adjustability.

6. The apparatus of claim 1 wherein the second side of the triangle clamp comprises a pair of parallel slots, and the angle adjustment bracket comprises a first portion having a first aperture and a second arc-shaped aperture, and wherein at least two screws are provided to releasably secure the angle adjustment bracket to the slots of the triangle clamp such that the angle of the angle adjustment bracket relative to the triangle clamp can be adjusted by loosening the screw in the second arc-shaped aperture and pivoting the angle adjustment bracket about the first aperture.

7. The apparatus of claim 6 wherein the arc-shaped aperture permits the angle adjustment bracket to pivot provide approximately 15° (fifteen degrees) of angle adjustment.

8. The apparatus of claim 6 wherein a double nut is provided to secure the angle adjustment bracket to the triangle clamp.

9. The apparatus of claim 1 wherein means for releasably securing comprises a quick release mechanism.

10. The apparatus of claim 9 wherein the quick release mechanism employs an expanding-post-style quick release mechanism comprising:

an upper tube having a passage therethrough, an angled bottom surface and a groove partially around the angled bottom surface;

a lower tube having a passage therethrough, an angled upper surface and a groove partially around the angled upward surface;

a gasket, the gasket fitting into the groove around the angled surfaces in the upper tube and the lower tube;

a post cone, the post cone having a threaded passage therethrough;

a cam lever operable to move a skewer, the skewer being connected to the lower tube, the lower tube being upwardly movable along the angled bottom surface of the upper tube so as to expand the width of the combined upper and lower tube and secure the cane clamp within the upwardly facing aperture in the angle adjustment bracket.

* * * * *